US009235155B2

(12) United States Patent
Ishii

(10) Patent No.: US 9,235,155 B2
(45) Date of Patent: Jan. 12, 2016

(54) IMAGE FORMING APPARATUS

(71) Applicant: Oki Data Corporation, Tokyo (JP)

(72) Inventor: Takeshi Ishii, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 14/689,779

(22) Filed: Apr. 17, 2015

(65) Prior Publication Data

US 2015/0309440 A1 Oct. 29, 2015

(30) Foreign Application Priority Data

Apr. 24, 2014 (JP) ..... 2014-089988

(51) Int. Cl.
*G03G 15/06* (2006.01)
*G03G 15/08* (2006.01)

(52) U.S. Cl.
CPC ..... *G03G 15/065* (2013.01); *G03G 15/0812* (2013.01)

(58) Field of Classification Search
CPC ..... G03G 15/065; G03G 15/0812
See application file for complete search history.

(56) References Cited

U.S. PATENT DOCUMENTS

2010/0303488 A1* 12/2010 Yanagi ..... G03G 15/065 399/45

FOREIGN PATENT DOCUMENTS

JP 2013-068811 A 4/2013

OTHER PUBLICATIONS

Machine translation of reference Koido (JP Pub No. 2013-068,811 A), Listed in IDS, Pub Date Apr. 18, 2013.*

* cited by examiner

*Primary Examiner* — Rodney Bonnette
(74) *Attorney, Agent, or Firm* — Rabin & Berdo, P.C.

(57) ABSTRACT

Provided is an image forming apparatus that includes a first image forming section configured to form an auxiliary layer, a second image forming section configured to form an image layer, and a controller. The first and the second image forming sections each include an image supporting member configured to support a latent image on a surface thereof and a developer supporting member configured to support, on a surface thereof, a developer. The controller is configured to control the first and the second image forming sections to allow a first velocity and a second velocity to be different from each other. The first velocity is a traveling velocity of the surface of the developer supporting member in the first image forming section, and the second velocity is a traveling velocity of the surface of the developer supporting member in the second image forming section.

15 Claims, 14 Drawing Sheets

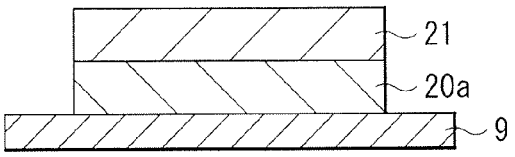

FIG. 3

| | |
|---|---|
| ABSOLUTE VALUE \|Va3\| OF VOLTAGE Va3 APPLIED TO DEVELOPING ROLLER 113 | \|Va3(W)\| ≈ \|Va3(C, M, Y, K)\| (or \|Va3(W)\| < \|Va3(C, M, Y, K)\|) |
| CIRCUMFERENTIAL VELOCITY Sp3 OF DEVELOPING ROLLER 113 | Sp3(W) ≠ Sp3(C, M, Y, K) (Sp3(W) > Sp3(C, M, Y, K)) |
| CIRCUMFERENTIAL VELOCITY Sp1 OF PHOTOSENSITIVE DRUM 111 | Sp1(W) ≈ Sp1(C, M, Y, K) |
| RATIO OF CIRCUMFERENTIAL VELOCITY Sp3 OF DEVELOPING ROLLER 113 TO CIRCUMFERENTIAL VELOCITY Sp1 OF PHOTOSENSITIVE DRUM 111 Rp(=Sp3/Sp1) | Rp(W) ≠ Rp(C, M, Y, K) (Rp(W) > Rp(C, M, Y, K)) |
| ABSOLUTE VALUE \|Va5\| OF VOLTAGE Va5 APPLIED TO TONER REGULATING MEMBER 115 | \|Va5(W)\| ≠ \|Va5(C, M, Y, K)\| (\|Va5(W)\| < \|Va5(C, M, Y, K)\|) |

FIG. 4

| COLOR OF TONER | WHITE (W) | OTHER COLORS (C, M, Y, K) |
|---|---|---|
| VOLTAGE Va3 APPLIED TO DEVELOPING ROLLER 113 [-V] | Va3 (W) =200 | Va3 (C, M, Y, K) =200 |
| CIRCUMFERENTIAL VELOCITY Sp3 OF DEVELOPING ROLLER 113 [mm/s] | Sp3 (W) =350 | Sp3 (C, M, Y, K) =300 |
| CIRCUMFERENTIAL VELOCITY Sp1 OF PHOTOSENSITIVE DRUM 111 [mm/s] | Sp1 (W) =230 | Sp1 (C, M, Y, K) =230 |
| CIRCUMFERENTIAL VELOCITY RATIO Rp (=Sp3/Sp1) | Rp (W) =1.5 | Rp (C, M, Y, K) =1.3 |
| VOLTAGE Va5 APPLIED TO TONER REGULATING MEMBER 115 [-V] | Va5 (W) =150 | Va5 (C, M, Y, K) =300 |

| | |
|---|---|
| ABSOLUTE VALUE \|Va3\| OF VOLTAGE Va3 APPLIED TO DEVELOPING ROLLER 113 | \|Va3(W)\| ≈ \|Va3(C, M, Y, K)\| (or \|Va3(W)\| < \|Va3(C, M, Y, K)\|) |
| CIRCUMFERENTIAL VELOCITY Sp3 OF DEVELOPING ROLLER 113 | Sp3(W) ≠ Sp3(C, M, Y, K) (Sp3(W) < Sp3(C, M, Y, K)) |
| CIRCUMFERENTIAL VELOCITY Sp1 OF PHOTOSENSITIVE DRUM 111 | Sp1(W) ≈ Sp1(C, M, Y, K) |
| RATIO OF CIRCUMFERENTIAL VELOCITY Sp3 OF DEVELOPING ROLLER 113 TO CIRCUMFERENTIAL VELOCITY Sp1 OF PHOTOSENSITIVE DRUM 111 Rp(=Sp3/Sp1) | Rp(W) ≠ Rp(C, M, Y, K) (Rp(W) < Rp(C, M, Y, K)) |
| ABSOLUTE VALUE \|Va5\| OF VOLTAGE Va5 APPLIED TO TONER REGULATING MEMBER 115 | \|Va5(W)\| ≠ \|Va5(C, M, Y, K)\| (\|Va5(W)\| > \|Va5(C, M, Y, K)\|) |

FIG. 16

IMAGE FORMING APPARATUS

CROSS REFERENCE TO RELATED APPLICATIONS

This application claims the benefit of Japanese Priority Patent Application JP2014-089988 filed on Apr. 24, 2014, the entire contents of which are incorporated herein by reference.

BACKGROUND

The invention relates to an image forming apparatus that forms an image with use of an electrophotographic process.

There has been proposed an electrophotographic image forming apparatus in which a white toner is used in addition to color toners. For example, reference is made to Japanese Unexamined Patent Application Publication No. 2013-68811. Forming a layer (a white toner image) such as an underlayer of an image layer (color toner images) with use of the white toner allows for reduction in an influence exerted by a ground color of a recording medium (a transfer member) that, for example, may have a color tone or may be made of a transparent material, and allows for improvement in color development accordingly.

SUMMARY

In general, it is desirable that an image forming apparatus achieve a favorable image (or to improve image quality).

It is desirable to provide an image forming apparatus that makes it possible to achieve a favorable image.

An image forming apparatus according to an embodiment of the invention includes: a first image forming section including an image supporting member and a developer supporting member, and configured to form an auxiliary layer, in which the image supporting member is configured to support a latent image on a surface thereof, and the developer supporting member is configured to support, on a surface thereof, a developer that is to be supplied to the image supporting member and allows the latent image to be developed; a second image forming section including an image supporting member and a developer supporting member, and configured to form an image layer, in which the image supporting member is configured to support a latent image on a surface thereof, and the developer supporting member is configured to support, on a surface thereof, a developer that is to be supplied to the image supporting member and allows the latent image to be developed; and a controller configured to control the first image forming section and the second image forming section to allow a first velocity and a second velocity to be different from each other, in which the first velocity is a traveling velocity of the surface of the developer supporting member in the first image forming section, and the second velocity is a traveling velocity of the surface of the developer supporting member in the second image forming section.

An image forming apparatus according to an embodiment of the invention includes: a first image forming section including an image supporting member and a developer supporting member, and configured to form an auxiliary layer, in which the image supporting member is configured to support a latent image on a surface thereof, and the developer supporting member is configured to support, on a surface thereof, a developer that is to be supplied to the image supporting member and allows the latent image to be developed; a second image forming section including an image supporting member and a developer supporting member, and configured to form an image layer, in which the image supporting member is configured to support a latent image on a surface thereof, and the developer supporting member is configured to support, on a surface thereof, a developer that is to be supplied to the image supporting member and allows the latent image to be developed; and a controller configured to control the first image forming section and the second image forming section to allow a first velocity ratio and a second velocity ratio to be different from each other, in which the first velocity ratio is a ratio of a traveling velocity of the surface of the developer supporting member to a traveling velocity of the surface of the image supporting member in the first image forming section, and the second velocity ratio is a ratio of a traveling velocity of the surface of the developer supporting member to a traveling velocity of the surface of the image supporting member in the second image forming section.

An image forming apparatus according to an embodiment of the invention includes: a first image forming section including an image supporting member, a developer supporting member, a developer regulating member, and a power supply section, and configured to form an auxiliary layer, in which the image supporting member is configured to support a latent image on a surface thereof, the developer supporting member is configured to support, on a surface thereof, a developer that is to be supplied to the image supporting member and allows the latent image to be developed, the developer regulating member is configured to be in contact with the surface of the developer supporting member to form a layer of the developer on the surface of the developer supporting member, and the power supply section is configured to apply a voltage to the developer regulating member; a second image forming section including an image supporting member, a developer supporting member, a developer regulating member, and a power supply section, and configured to form an image layer, in which the image supporting member is configured to support a latent image on a surface thereof, the developer supporting member is configured to support, on a surface thereof, a developer that is to be supplied to the image supporting member and allows the latent image to be developed, the developer regulating member is configured to be in contact with the surface of the developer supporting member to form a layer of the developer on the surface of the developer supporting member, and the power supply section is configured to apply a voltage to the developer regulating member; and a controller configured to control the power supply sections to allow a first voltage value and a second voltage value to be different from each other, in which the first voltage value is an absolute value of the voltage applied to the developer regulating member in the first image forming section, and the second voltage value is an absolute value of the voltage applied to the developer regulating member in the second image forming section.

It is possible for the image forming apparatus according to each of the above-described embodiments of the invention to achieve a favorable image.

It is to be understood that both the foregoing general description and the following detailed description are exemplary, and are intended to provide further explanation of the invention as claimed. Also, effects of the invention are not limited to those described above. Effects achieved by the invention may be those that are different from the above-described effects, or may include other effects in addition to those described above.

BRIEF DESCRIPTION OF THE DRAWINGS

FIG. 3 schematically illustrates an example of a cross-sectional configuration of an image layer and an underlayer formed by the image forming apparatus illustrated in FIG. 1.

FIG. 4 illustrates an example of a control of various parameters in each of the image forming sections illustrated in FIG. 2.

FIG. 16 illustrates an example of a control of various parameters according to a first modification example.

DETAILED DESCRIPTION

In the following, some embodiments of the invention are described in detail, in the following order, with reference to the accompanying drawings.

1. Example Embodiment (an example of an image forming apparatus that forms an underlayer with use of a white toner)
2. Modification Examples First Modification Example (an example in which a control is so performed that a relationship in magnitude of various parameters in the example embodiment is reversed)

Second Modification Example (an example of an image forming apparatus that forms an overcoat layer with use of the white toner)

3. Other Modification Examples

1. EXAMPLE EMBODIMENT

Configuration

Figure 1:
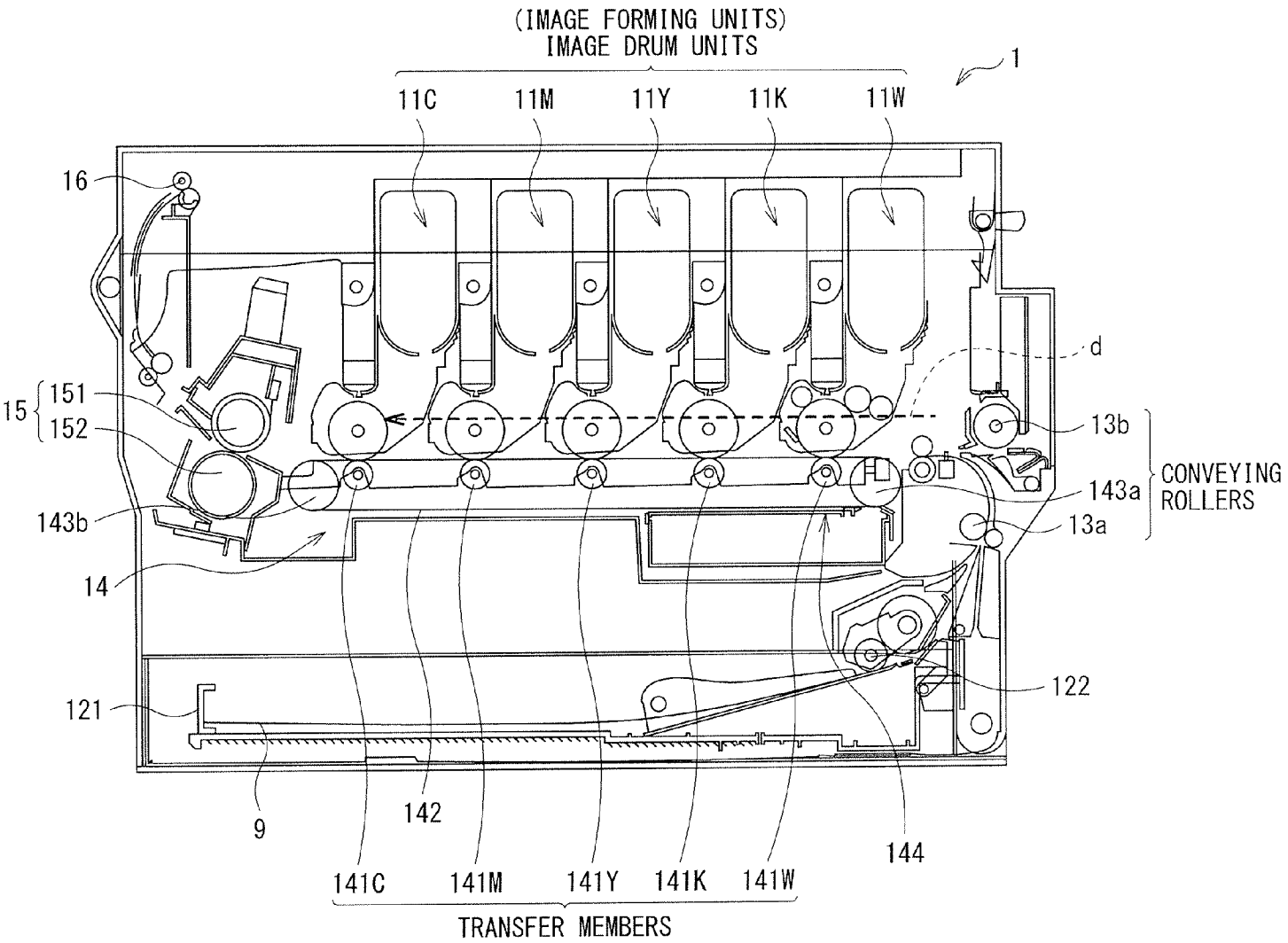
FIG. 1 schematically illustrates an example of an outline configuration of an image forming apparatus according to an embodiment of the invention.

FIG. 1 schematically illustrates an example of an outline configuration of an image forming apparatus (an image forming apparatus 1) according to an embodiment of the invention. The image forming apparatus 1 may function as a printer that forms an image on a recording medium 9 with use of an electrophotographic process. In this example embodiment, the printer may be a color printer that forms a color image. The recording medium 9 (or a printed medium, a transfer member, etc.) may be, for example but not limited to, paper.

Referring to FIG. 1, the image forming apparatus 1 may include five image drum units (image forming units) 11C, 11M, 11Y, 11K, and 11W, a medium feeding tray (paper feeding tray) 121, a hopping roller 122, conveying rollers 13*a* and 13*b*, a transfer belt unit 14, a fixing unit 15, and a discharging roller 16. Each of such members is provided inside a predetermined housing.

[Image Drum Units 11C, 11M, 11Y, 11K, and 11W]

The image drum units 11C, 11M, 11Y, 11K, and 11W each function as a developing unit of the recording medium 9, and are disposed side by side in a conveying direction "d" of the recording medium 9 as illustrated in FIG. 1. In one specific example, the image drum units are disposed in order of the image drum units 11W, 11K, 11Y, 11M, and 11C in the conveying direction "d" (from the upstream side to the downstream side).

The image drum units 11C, 11M, 11Y, 11K, and 11W have the same configuration as one another basically, with the exception that the image drum units 11C, 11M, 11Y, 11K, and 11W form respective toner images (developer images) with use of respective toners that are different in color from one another. More specifically, the image drum unit 11C uses a cyan (C) toner to form a cyan toner image, the image drum unit 11M uses a magenta (M) toner to form a magenta toner image, and the image drum unit 11Y uses a yellow (Y) toner to form a yellow toner image. Likewise, the image drum unit 11K uses a black (K) toner to form a black toner image, and the image drum unit 11W uses a white (W) toner to form a white toner image. An example of a detailed configuration of each of the image drum units 11C, 11M, 11Y, 11K, and 11W is described later with reference to FIG. 2.

Such toners having respective colors each may include additives such as, but not limited to, a predetermined colorant, a predetermined releasing agent, a predetermined charge controller, and a predetermined processing agent, and may be manufactured through mixing of those components on an as-needed basis or through a surface treatment. Among such additives, the colorant, the releasing agent, and the charge controller each serve as an internal additive. Non-limiting examples of an external additive may include silica and a titanium oxide, for which a resin such as, but not limited to, a polyester resin may be used as a binder resin.

The colorant used for each of the cyan toner, the magenta toner, the yellow toner, and the black toner may be a dye and/or a pigment that may be used alone or in any combination of different kinds of colorants. Non-limiting examples of the colorant may include carbon black, iron oxide, Permanent Brown FG, Pigment Green B, Pigment Blue 15:3, Solvent Blue 35, Solvent Red 49, Solvent Red 146, quinacridone, Carmine 6B, naphthol, disazo yellow, and isoindoline.

The colorant used for the white toner may be a pigment having high specific gravity, such as, but not limited to, a metal oxide generally used for a white pigment. Non-limiting examples of the metal oxide may include a titanium oxide and a zinc oxide. The white pigment may be subjected to a surface treatment, or may be used in any combination of different kinds of pigments, for example. Note that the colorant used for the white toner may have a large content of white pigment in consideration of coloring strength and concealing strength.

In one embodiment of the invention, the toners having respective colors described above each correspond to a concrete but non-limiting example of a "developer". Also, the white toner corresponds to a concrete but non-limiting example of a "white developer", and the cyan toner, the magenta toner, the yellow toner, and the black toner each correspond to a concrete but non-limiting example of "a monochrome developer having a color other than white", in one embodiment of the invention.

The medium feeding tray 121 is a member that stores the recording medium 9 in a stacked fashion, and is attachable to and detachable from the image forming apparatus 1. The medium feeding tray 121 may be provided inside the image forming apparatus 1 at a lower part thereof.

The hopping roller 122 is a member that takes the recording medium 9 stored in the medium feeding tray 121 out of the medium feeding tray 121 one by one from the top, and feeds the taken out recording medium 9 towards the conveying rollers 13*a* and 13*b*.

The conveying rollers 13*a* and 13*b* are members that cooperate as a pair to correct skew of the recording medium 9 fed from the hopping roller 122, and convey the corrected recording medium 9 to the transfer belt unit 14.

[Transfer Belt Unit 14]

The transfer belt unit 14 is a member that conveys the recording medium 9 conveyed from the conveying rollers 13*a* and 13*b* in the conveying direction "d", and transfers the toner images formed by the respective image drum units 11C, 11M, 11Y, 11K, and 11W onto the recording medium 9 sequentially in the conveying direction "d". The transfer belt unit 14 includes transfer members (transfer rollers) 141C, 141M, 141Y, 141K, and 141W, a transfer belt 142, conveying rollers 143*a* and 143*b*, and a transfer cleaning member 144, as illustrated in FIG. 1.

The transfer members 141C, 141M, 141Y, 141K, and 141W are members (rollers) that electrostatically transfer the respective toner images, formed in the respective image drum units 11C, 11M, 11Y, 11K, and 11W, onto the recording medium 9 as described above. The transfer members 141C, 141M, 141Y, 141K, and 141W are disposed to oppose the image drum units 11C, 11M, 11Y, 11K, and 11W through the transfer belt 142, respectively. More specifically, the transfer member 141C is opposed to the image drum unit 11C, the transfer member 141M is opposed to the image drum unit 11M, and the transfer member 141Y is opposed to the image drum unit 11Y. Likewise, the transfer member 141K is opposed to the image drum unit 11K, and the transfer member 141W is opposed to the image drum unit 11W. The transfer members 141C, 141M, 141Y, 141K, and 141W each may be, for example but not limited to, a foamed semi-conductive elastic rubber member.

The transfer belt 142 is a belt that causes the recording medium 9, conveyed from the conveying rollers 13*a* and 13*b*, to be electrostatically absorbed onto the transfer belt 142, and conveys the recording medium 9 absorbed electrostatically thereon in the conveying direction "d".

The conveying rollers 143*a* and 143*b* are each a member that operates the transfer belt 142.

The transfer cleaning member 144 is a member that scrapes the toner attached onto the transfer belt 142 to clean the transfer belt 142.

[Fixing Unit 15]

The fixing unit 15 is a member that applies heat and pressure to the toners (the toner images) on the recording medium 9, conveyed from the transfer belt unit 14, to fix the toners onto the recording medium 9. The fixing unit 15 includes a heat roller 151 and a backup roller 152, as illustrated in FIG. 1.

The heat roller 151 is a member (a heating roller) that includes therein a heater, and applies heat to the toners on the recording medium 9. The heater may be, for example but not limited to, a halogen lamp.

The backup roller 152 is a member (a pressurizing roller) that is so disposed as to form a pressure contact part between the backup roller 152 and the heat roller 151, and applies pressure onto the toners on the recording medium 9.

The discharging roller 16 is a member that discharges the recording medium 9, onto which the toners are fixed by the fixing unit 15, to the outside of the image forming apparatus 1.

[Image Forming Sections 10C, 10M, 10Y, 10K, and 10W]

Figure 2:
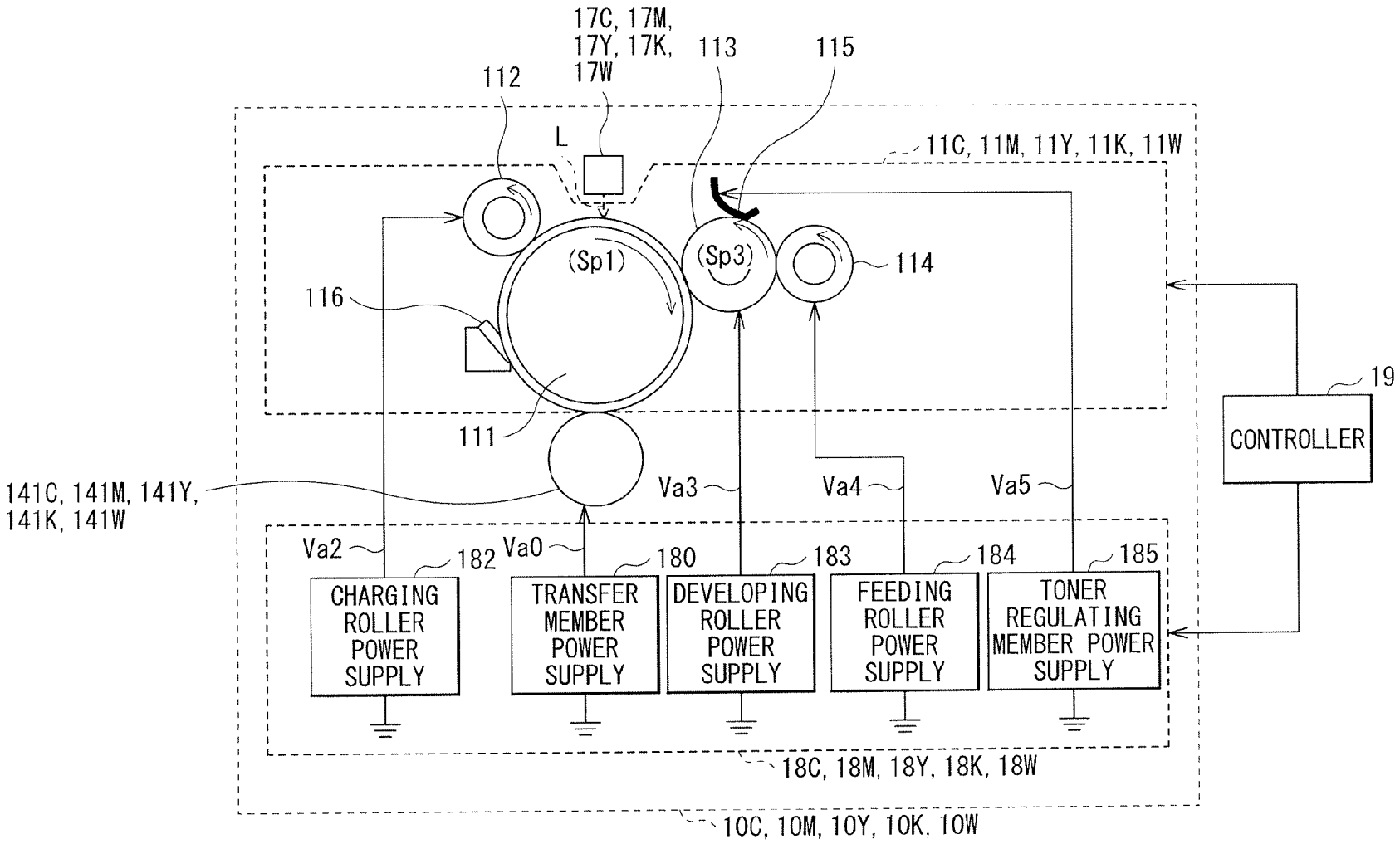
FIG. 2 schematically illustrates an example of an outline configuration of sections including an image forming section that includes an image drum unit illustrated in FIG. 1.

FIG. 2 schematically illustrates an example of an outline configuration of image forming sections 10C, 10M, 10Y, 10K, and 10W, together with a controller 19 that controls those image forming sections 10C, 10M, 10Y, 10K, and 10W. The image forming sections 10C, 10M, 10Y, 10K, and 10W include the image drum units 11C, 11M, 11Y, 11K, and 11W illustrated in FIG. 1, respectively.

As with the image drum units 11C, 11M, 11Y, 11K, and 11W described above, the image forming sections 10C, 10M, 10Y, 10K, and 10W have the same configuration as one another basically, with the exception that the image forming sections 10C, 10M, 10Y, 10K, and 10W form images (the toner images) with use of the respective toners that are different in color from one another.

Among the image forming sections 10C, 10M, 10Y, 10K, and 10W, the image forming sections 10C, 10M, 10Y, and 10K use corresponding one of the toners having respective colors (the cyan toner, the magenta toner, the yellow toner, and the black toner) to form an image layer 21, as illustrated by way of example in FIG. 3. FIG. 3 is a schematic cross-sectional view of the image layer 21 configured of the toner images having the respective colors.

On the other hand, in this example embodiment, the image forming section 10W uses the white toner to form an underlayer 20*a* of the image layer 21, as illustrated by way of example in a schematic cross-sectional view in FIG. 3. The underlayer 20*a* may be formed between the recording medium 9 and the image layer 21 (i.e., a lower layer of the image layer 21), and has an auxiliary function for formation of the image layer 21 as described later. In the example embodiment, the underlayer 20*a* may be a monochrome layer in white (a white layer). In one embodiment of the invention, the underlayer 20*a* corresponds to a concrete but non-limiting example of an "auxiliary layer", a "monochrome layer", or a "white layer".

Also, in one embodiment of the invention, the image forming section 10W corresponds to a concrete but non-limiting example of a "first image forming section" or an "image forming section". The image forming sections 10C, 10M, 10Y, and 10K each correspond to a concrete but non-limiting example of a "second image forming section", in one embodiment of the invention.

Referring to FIG. 2, the image forming section 10C may include the image drum unit 11C, the transfer member 141C described above, an exposure unit 17C, and a power supply unit 18C. Likewise, the image forming section 10M may include the image drum unit 11M, the transfer member 141M described above, an exposure unit 17M, and a power supply unit 18M. The image forming section 10Y may include the image drum unit 11Y, the transfer member 141Y described above, an exposure unit 17Y, and a power supply unit 18Y. The image forming section 10K may include the image drum unit 11K, the transfer member 141K described above, an exposure unit 17K, and a power supply unit 18K. The image forming section 10W may include the image drum unit 11W, the transfer member 141W described above, an exposure unit 17W, and a power supply unit 18W.

The image drum units 11C, 11M, 11Y, 11K, and 11W each may include a photosensitive drum 111, a charging roller 112, a developing roller 113, a feeding roller 114, a toner regulating member 115, and a cleaning member 116, as illustrated in FIG. 2.

The photosensitive drum 111 is a member that supports an electrostatic latent image on a surface (a superficial part) of the photosensitive drum 111, and includes a photoreceptor which may be, for example but not limited to, an organic photoreceptor. For example, the photosensitive drum 111 may include a conductive supporting member, and a photoconductive layer that covers an outer circumference part (a surface) of the conductive supporting member. The conductive supporting member may be, for example but not limited to, a metal pipe made of aluminum. The photoconductive layer may have a configuration in which a charge generating layer and a charge transporting layer are stacked in order, for example. The photosensitive drum 111 is configured to be rotated at a predetermined circumferential velocity Sp1 as illustrated in FIG. 2 (may be rotated clockwise as denoted by an arrow in the example embodiment). In one embodiment of the invention, the photosensitive drum 111 corresponds to a concrete but non-limiting example of an "image supporting member". Also, the circumferential velocity Sp1 of the photosensitive drum 111 corresponds to a concrete but non-limiting example of a "traveling velocity of the surface of the image supporting member", and the electrostatic latent image corresponds to a concrete but non-limiting example of a "latent image", in one embodiment of the invention.

The charging roller 112 is a member (a charging member) that charges the surface (the superficial part) of the photosensitive drum 111, and is so disposed as to be in contact with the surface (a circumferential surface) of the photosensitive drum 111. The charging roller 112 may include a metal shaft, and a semi-conductive rubber layer that covers an outer circumference part (a surface) of the metal shaft, for example. The semi-conductive rubber layer may be, for example but not limited to, a semi-conductive epichlorohydrin rubber layer. In the example embodiment, the charging roller 112 may be rotated counterclockwise as denoted by an arrow in FIG. 2 (i.e., rotated in an opposite direction to the photosensitive drum 111).

The developing roller 113 is a member that supports the toner, used for development of the electrostatic latent image, on a surface of the developing roller 113, and is so disposed as to be in contact with the surface (the circumferential surface) of the photosensitive drum 111. The developing roller 113 may include a metal shaft, and a semi-conductive rubber layer that covers an outer circumference part (a surface) of the metal shaft, for example. The semi-conductive rubber layer may be, for example but not limited to, a semi-conductive urethane rubber layer. The developing roller 113 is configured to be rotated at a predetermined circumferential velocity Sp3 as illustrated in FIG. 2 (may be rotated counterclockwise, i.e., in the opposite direction to the photosensitive drum 111, as denoted by an arrow in the example embodiment). In one embodiment of the invention, the developing roller 113 corresponds to a concrete but non-limiting example of a "developer supporting member". Also, the circumferential velocity Sp3 of the developing roller 113 corresponds to a concrete but non-limiting example of a "traveling velocity of the surface of the developer supporting member", in one embodiment of the invention.

The feeding roller 114 is a member (a feeding member) that feeds the toner to the developing roller 113, and is so disposed as to be in contact with the surface (a circumferential surface) of the developing roller 113. The feeding roller 114 may include a metal shaft, and a rubber layer that covers an outer circumference part (a surface) of the metal shaft, for example. The rubber layer may be, for example but not limited to, a foamed silicone rubber layer. In the example embodiment, the feeding roller 114 may be rotated counterclockwise as denoted by an arrow in FIG. 2 (i.e., rotated in the same direction as the developing roller 113).

The toner regulating member 115 is a member that comes into contact with the surface of the developing roller 113 to form a layer made of the toner (i.e., a toner layer) on the surface of the developing roller 113 and regulate (control or adjust) a thickness of that toner layer. The toner regulating member 115 may be a plate-shaped elastic member (a plate spring) which may be made of, for example but not limited to, a stainless steel, and is disposed such that a tip of the plate-shaped elastic member comes into slight contact with the surface of the developing roller 113. In one embodiment of the invention, the toner regulating member 115 corresponds to a concrete but non-limiting example of a "developer regulating member". Also, the toner layer described above corresponds to a concrete but non-limiting example of a "layer of the developer", in one embodiment of the invention.

The cleaning member 116 is a member that scrapes the toner remaining on the surface (the superficial part) of the photosensitive drum 111 to clean the surface of the photosensitive drum 111. The cleaning member 116 is so disposed in opposition to the photosensitive drum 111 as to come into contact with the surface of the photosensitive drum 111, i.e., so disposed as to protrude in a direction opposite to the direction of rotation of the photosensitive drum 111. For example, the cleaning member 116 may be made of an elastic body such as, but not limited to, a polyurethane rubber.

The exposure units 17C, 17M, 17Y, 17K, and 17W illustrated in FIG. 2 are each an unit that performs exposure of the surface of the corresponding photosensitive drum 111 by irradiating the surface of the photosensitive drum 111 with irradiation light L as illustrated in FIG. 2, to thereby form the electrostatic latent image on the surface (the superficial part) of the corresponding photosensitive drum 111. The exposure units 17C, 17M, 17Y, 17K, and 17W each may include a plurality of light sources that emit the irradiation light L and a lens array that causes the irradiation light L to be focused on the surface of the corresponding photosensitive drum 111, for example. Non-limiting examples of each of the light sources may include a light-emitting diode (LED) and a laser device.

The power supply units 18C, 18M, 18Y, 18K, and 18W illustrated in FIG. 2 each may include a transfer member power supply 180, a charging roller power supply 182, a developing roller power supply 183, a feeding roller power supply 184, and a toner regulating member power supply 185.

The transfer member power supply 180 is a power supply that applies a voltage (an applied voltage Va0) to the corresponding transfer member 141C, 141M, 141Y, 141K, or 141W, as illustrated in FIG. 2. The applied voltage Va0 may be a bias voltage having a polarity reverse to a polarity of each of the toners having respective colors. For example, the toners each may have a negative polarity (the same applies to the following description), and the applied voltage Va0 may thus have a positive polarity. In an alternative embodiment, however, the applied voltage Va0 may be a bias voltage that has the same polarity (for example, the negative polarity) as each of the toners.

The charging roller power supply 182 is a power supply that applies a voltage (an applied voltage Va2) to the corresponding charging roller 112, as illustrated in FIG. 2. The applied voltage Va2 may be a bias voltage that has the same polarity (for example, the negative polarity) as each of the toners having the respective colors.

The developing roller power supply 183 is a power supply that applies a voltage (an applied voltage Va3) to the corresponding developing roller 113, as illustrated in FIG. 2. The applied voltage Va3 may be a bias voltage that has the same polarity (for example, the negative polarity) as each of the toners having the respective colors. In an alternative embodiment, however, the applied voltage Va3 may be a bias voltage that has a reverse polarity (for example, the positive polarity) to each of the toners. In one embodiment of the invention, the developing roller power supply 183 corresponds to a concrete but non-limiting example of a "second power supply section". Also, the applied voltage Va3 corresponds to a concrete but non-limiting example of a "voltage applied to the developer supporting member", in one embodiment of the invention.

The feeding roller power supply 184 is a power supply that applies a voltage (an applied voltage Va4) to the corresponding feeding roller 114, as illustrated in FIG. 2. The applied voltage Va4 may be a bias voltage that has the same polarity (for example, the negative polarity) as each of the toners having the respective colors. In an alternative embodiment, however, the applied voltage Va4 may be a bias voltage that has a reverse polarity (for example, the positive polarity) to each of the toners.

The toner regulating member power supply 185 is a power supply that applies a voltage (an applied voltage Va5) to the corresponding toner regulating member 115, as illustrated in FIG. 2. The applied voltage Va5 may be a bias voltage that has the same polarity (for example, the negative polarity) as each of the toners having the respective colors. In an alternative embodiment, however, the applied voltage Va5 may be a bias voltage that has a reverse polarity (for example, the positive polarity) to each of the toners. In one embodiment of the invention, the toner regulating member power supply 185 corresponds to a concrete but non-limiting example of a "power supply section" or a "first power supply section". Also, the applied voltage Va5 corresponds to a concrete but non-limiting example of a "voltage applied to the developer regulating member", in one embodiment of the invention.

Note that the terms "same polarity" and "reverse polarity" as used herein each do not refer to the positive polarity or the negative polarity in a strict sense. The terms "same polarity" and "reverse polarity" as used herein are to be construed as referring to polarities that are defined based on a relative magnitude relationship between values of the respective applied voltages.

[Controller 19]

The controller 19 illustrated in FIG. 2 is configured to statically or dynamically control (set or adjust) an operation of each of the image forming sections 10C, 10M, 10Y, 10K, and 10W. For example, the controller 19 controls an operation of each of the image drum units 11C, 11M, 11Y, 11K, and 11W and an operation of each of the power supply units 18C, 18M, 18Y, 18K, and 18W in the respective image forming sections 10C, 10M, 10Y, 10K, and 10W, as illustrated in FIG. 2.

More specifically, the controller 19 controls operations of the respective photosensitive drum 111, charging roller 112, developing roller 113, feeding roller 114, toner regulating member 115, and cleaning member 116 in each of the image drum units 11C, 11M, 11Y, 11K, and 11W. The operations controlled by the controller 19 may include, for example but not limited to, the circumferential velocity and a ratio between the circumferential velocities which are to be described later. Also, the controller 19 controls operations (which may be, for example but not limited to, absolute values of the voltages to be described later, etc.) of the respective transfer member power supply 180, charging roller power supply 182, developing roller power supply 183, feeding roller power supply 184, and toner regulating member power supply 185 in each of the power supply units 18C, 18M, 18Y, 18K, and 18W. The controller 19 may include a microcomputer and a drive mechanism, for example. The microcomputer may utilize devices such as a central processing unit (CPU), a read-only memory (ROM), and a random access memory (RAM). The drive mechanism may be a motor or any other suitable drive mechanism.

Figures 5, 6:
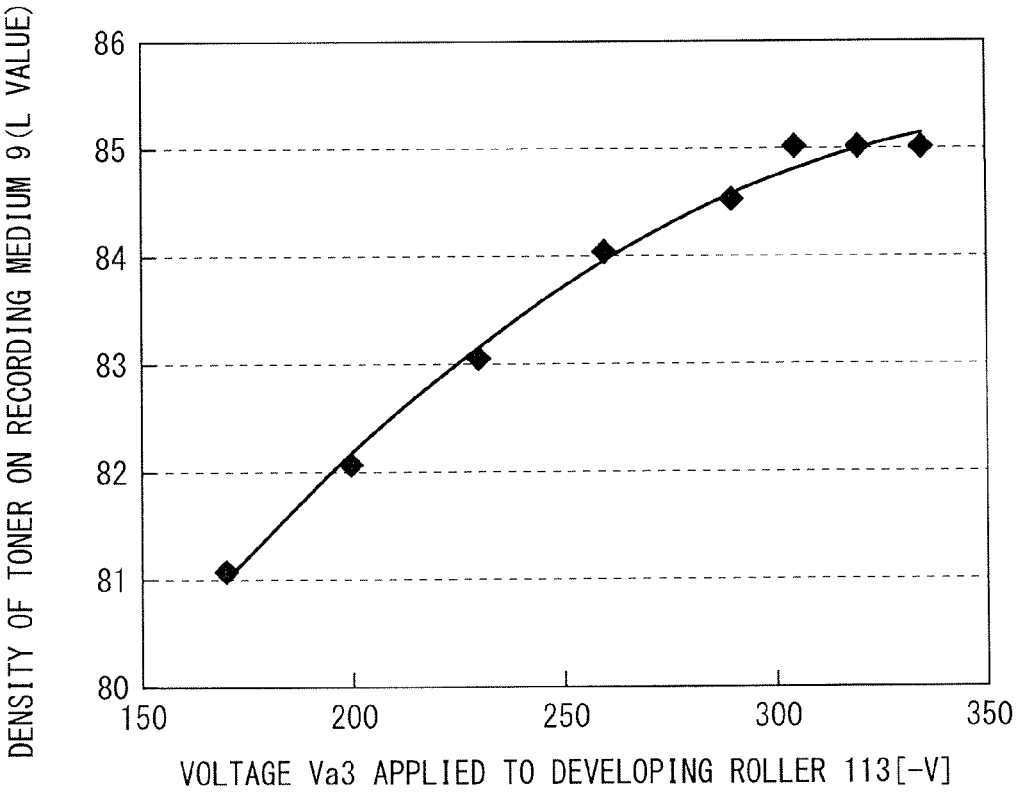
FIG. 5 illustrates a numerical example of the various parameters illustrated in FIG. 4.
FIG. 6 illustrates an example of a relationship of a voltage applied to a developing roller versus a density of a toner on a recording medium.

FIG. 4 illustrates, in table, an example of controlling (a setting example of) various parameters performed by the controller 19 for each of the image forming sections 10C, 10M, 10Y, 10K, and 10W. FIG. 5 illustrates, in table, a numerical example of the various parameters illustrated in FIG. 4. Note that examples (numerical examples) illustrated in FIGS. 6 to 14 to be described later each correspond to one embodiment that utilizes the various parameters illustrated in FIG. 5.

In this example embodiment, as illustrated in FIGS. 4 and 5, the various parameters controlled (set) by the controller 19 are parameters that are represented in the following (1) to (5). In each of the parameters represented in (1) to (5), values for the image forming section 10W and values for each of the image forming sections 10C, 10M, 10Y, and 10K are represented and defined as follows.

(1) Absolute Value |Va3| of Voltage Va3 applied to Developing Roller 113

The absolute value |Va3| in the image forming section 10W is defined as |Va3(W)|.

The absolute value |Va3| in each of the image forming sections 10C, 10M, 10Y, and 10K is defined as |Va3(C, M, Y, K)|.

(2) Circumferential Velocity Sp3 of Developing Roller 113

The circumferential velocity Sp3 in the image forming section 10W is defined as Sp3(W).

The circumferential velocity Sp3 in each of the image forming sections 10C, 10M, 10Y, and 10K is defined as Sp3 (C, M, Y, K).

(3) Circumferential Velocity Sp1 of Photosensitive Drum 111

The circumferential velocity Sp1 in the image forming section 10W is defined as Sp1(W).

The circumferential velocity Sp1 in each of the image forming sections 10C, 10M, 10Y, and 10K is defined as Sp1 (C, M, Y, K).

(4) Ratio of Circumferential Velocity Sp3 to Circumferential Velocity Sp1 (Circumferential Velocity Ratio Rp=Sp3/Sp1)

The circumferential velocity ratio Rp in the image forming section 10W is defined as a circumferential velocity ratio Rp(W) (=Sp3(W)/Sp1(W)).

The circumferential velocity ratio Rp in each of the image forming sections 10C, 10M, 10Y, and 10K is defined as a circumferential velocity ratio Rp(C, M, Y, K) (=Sp3(C, M, Y, K)/Sp1(C, M, Y, K)).

(5) Absolute Value |Va5| of Voltage Va5 applied to Toner Regulating Member 115

The absolute value |Va5| in the image forming section 10W is defined as |Va5(W)|.

The absolute value |Va5| in each of the image forming sections 10C, 10M, 10Y, and 10K is defined as |Va5(C, M, Y, K)|.

In one embodiment of the invention, the absolute value |Va3(W)| represented in (1) described above corresponds to a concrete but non-limiting example of an "absolute value of the voltage applied to the developer supporting member in the first image forming section". Also, the absolute value |Va3(C, M, Y, K)| represented in (1) corresponds to a concrete but non-limiting example of an "absolute value of the voltage applied to the developer supporting member in the second image forming section" in one embodiment of the invention.

The circumferential velocity Sp3(W) represented in (2) described above corresponds to a concrete but non-limiting example of a "first velocity", in one embodiment of the invention. Also, the circumferential velocity Sp3(C, M, Y, K) represented in (2) corresponds to a concrete but non-limiting example of a "second velocity", in one embodiment of the invention.

The circumferential velocity ratio Rp(W) represented in (4) described above corresponds to a concrete but non-limiting example of a "first velocity ratio", in one embodiment of the invention. Also, the circumferential velocity ratio Rp(C, M, Y, K) represented in (4) corresponds to a concrete but non-limiting example of a "second velocity ratio", in one embodiment of the invention.

The absolute value |Va5(W)| represented in (5) described above corresponds to a concrete but non-limiting example of a "first voltage value", in one embodiment of the invention. Also, the absolute value |Va5(C, M, Y, K)| represented in (5) corresponds to a concrete but non-limiting example of a "second voltage value", in one embodiment of the invention.

In this example embodiment, the controller 19 performs the control on each of the parameters represented in (1) to (5) described above in the following manner as illustrated in FIGS. 4, 5, etc.

(1) Control of Absolute Value |Va3|

Referring to FIG. 4, the controller 19 so controls the developing roller power supplies 183 in the respective power supply units 18C, 18M, 18Y, 18K, and 18W as to allow the absolute value |Va3(W)| and the absolute value |Va3(C, M, Y, K)| to be substantially equal to each other, i.e., as to satisfy the following expression (1a). Preferably, the controller 19 may so control the developing roller power supplies 183 as to allow the absolute value |Va3(W)| and the absolute value |Va3(C, M, Y, K)| to be equal to each other as illustrated in FIG. 5, i.e., as to satisfy the following expression (1b). Alternatively, the controller 19 may preferably so control the developing roller power supplies 183 as to allow the absolute value |Va3(W)| to be smaller than the absolute value |Va3(C, M, Y, K)| as illustrated in FIG. 4, i.e., as to satisfy the following expression (1c).

$$|Va3(W)|\approx|Va3(C,M,Y,K)| \quad (1a)$$

$$|Va3(W)|=|Va3(C,M,Y,K)| \quad (1b)$$

$$|Va3(W)|<|Va3(C,M,Y,K)| \quad (1c)$$

(2) Control of Circumferential Velocity Sp3

Figure 9:
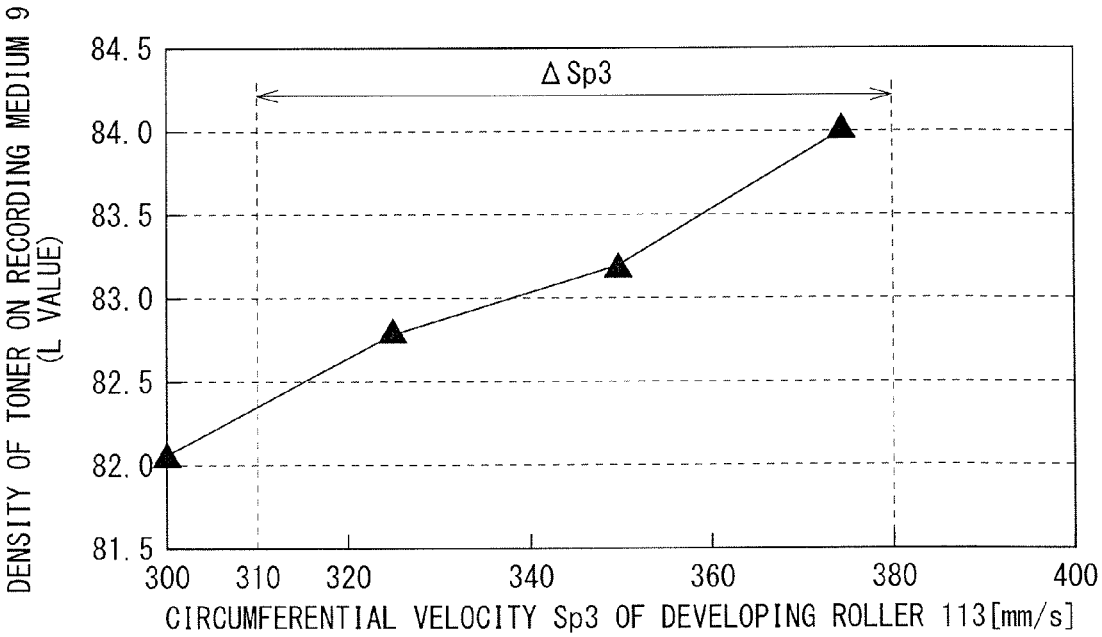
FIG. 9 illustrates an example of a relationship of a circumferential velocity of the developing roller versus the density of the toner on the recording medium.

Also, the controller 19 so controls the image drum units 11C, 11M, 11Y, 11K, and 11W as to allow the circumferential velocity Sp3(W) and the circumferential velocity Sp3(C, M, Y, K) to be different from each other as illustrated in FIGS. 4 and 5, i.e., as to satisfy the following expression (2a). Preferably, the controller 19 may so control the image drum units 11C, 11M, 11Y, 11K, and 11W as to allow the circumferential velocity Sp3(W) to be greater than the circumferential velocity Sp3(C, M, Y, K) as illustrated in FIGS. 4 and 5, i.e., as to satisfy the following expression (2b). Alternatively, the controller 19 may preferably so control the image drum unit 11W as to allow the circumferential velocity Sp3(W) to fall within a range from 310 [mm/s] to 380 [mm/s] as illustrated in FIG. 9 to be described later, i.e., as to satisfy the following expression (2c).

$$Sp3(W)\neq Sp3(C,M,Y,K) \quad (2a)$$

$$Sp3(W)>Sp3(C,M,Y,K) \quad (2b)$$

$$310\leq Sp3(W)\leq 380 \quad (2c)$$

(3) Control of Circumferential Velocity Sp1

Further, the controller 19 so controls the image drum units 11C, 11M, 11Y, 11K, and 11W as to allow the circumferential velocity Sp1(W) and the circumferential velocity Sp1(C, M, Y, K) to be substantially equal to each other, i.e., as to satisfy the following expression (3a). Preferably, the controller 19 may so control the image drum units 11C, 11M, 11Y, 11K, and 11W as to allow the circumferential velocity Sp1(W) and the circumferential velocity Sp1(C, M, Y, K) to be equal to each other as illustrated in FIGS. 4 and 5, i.e., as to satisfy the following expression (3b).

$$Sp1(W)\approx Sp1(C,M,Y,K) \quad (3a)$$

$$Sp1(W)=Sp1(C,M,Y,K) \quad (3b)$$

(4) Control of Circumferential Velocity Ratio Rp (=Sp3/Sp1)

Figure 10:
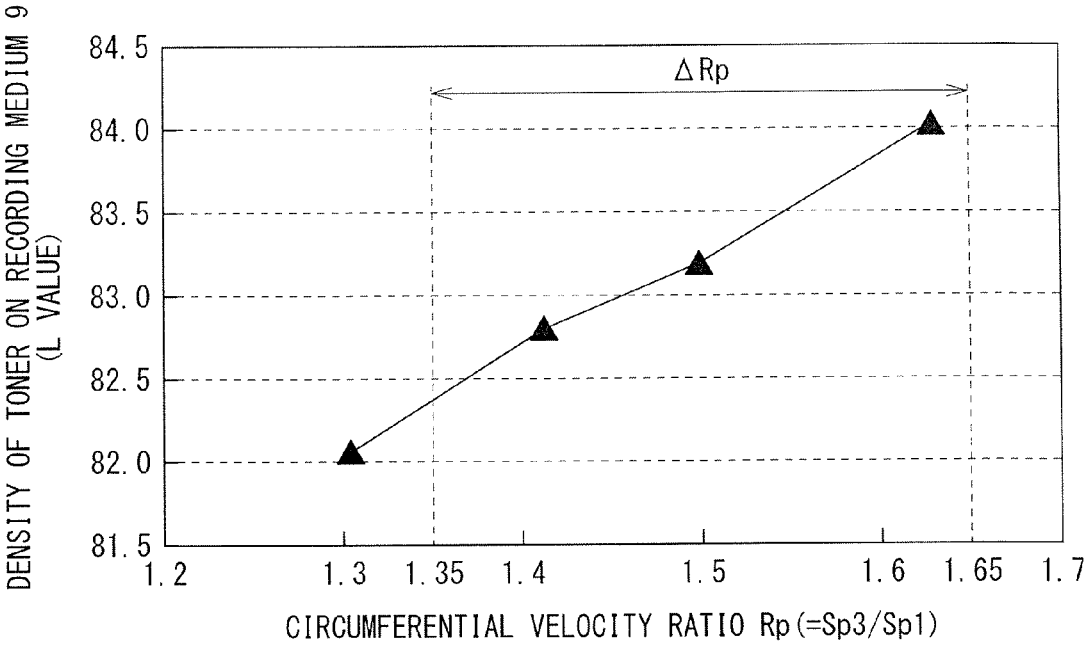
FIG. 10 illustrates an example of a relationship of a circumferential velocity ratio versus the density of the toner on the recording medium.

The controller 19 may so control the image drum units 11C, 11M, 11Y, 11K, and 11W as to allow the circumferential velocity ratio Rp(W) and the circumferential velocity ratio Rp(C, M, Y, K) to be different from each other as illustrated in FIGS. 4 and 5, i.e., as to satisfy the following expression (4a). Preferably, the controller 19 may so control the image drum units 11C, 11M, 11Y, 11K, and 11W as to allow the circumferential velocity ratio Rp(W) to be greater than the circumferential velocity ratio Rp(C, M, Y, K) as illustrated in FIGS. 4 and 5, i.e., as to satisfy the following expression (4b). Alternatively, the controller 19 may preferably so control the image drum unit 11W as to allow the circumferential velocity ratio Rp(W) to fall within a range from 1.35 to 1.65 as illustrated in FIG. 10 to be described later, i.e., as to satisfy the following expression (4c).

$$Rp(W)\neq Rp(C,M,Y,K) \quad (4a)$$

$$Rp(W)>Rp(C,M,Y,K) \quad (4b)$$

$$1.35\leq Rp(W)\leq 1.65 \quad (4c)$$

(5) Control of Absolute Value |Va5|

The controller 19 may so control the toner regulating member power supplies 185 in the respective power supply units 18C, 18M, 18Y, 18K, and 18W as to allow the absolute value |Va5(W)| and the absolute value |Va5(C, M, Y, K)| to be different from each other as illustrated in FIGS. 4 and 5, i.e., as to satisfy the following expression (5a). Preferably, the controller 19 may so control the toner regulating member power supplies 185 as to allow the absolute value |Va5(W)| to be smaller than the absolute value |Va5(C, M, Y, K)| as illustrated in FIGS. 4 and 5, i.e., as to satisfy the following expression (5b).

$$|Va5(W)| \neq |Va5(C,M,Y,K)| \quad (5a)$$

$$|Va5(W)| < |Va5(C,M,Y,K)| \quad (5b)$$

[Operation and Effect]

[A. Basic Operation]

The image forming apparatus 1 may form an image (the image layer 21 and the underlayer 20*a* thereof) on the recording medium 9 as follows.

First, referring to FIG. 1, the recording medium 9 stored in the medium feeding tray 121 is taken out of the medium feeding tray 121, one by one from the top, by the hopping roller 122 to be fed towards the conveying rollers 13*a* and 13*b*. Then, the recording medium 9 fed from the hopping roller 122 is subjected to skew correction by the conveying rollers 13*a* and 13*b*, following which the corrected recording medium 9 is conveyed to the transfer belt unit 14. The thus-conveyed recording medium 9 is conveyed by the transfer belt unit 14 in the conveying direction "d". While the recording medium 9 is conveyed in the conveying direction "d", the toner images formed in the respective image drum units 11C, 11M, 11Y, 11K, and 11W are transferred, sequentially in the conveying direction "d", onto the recording medium 9 in the following manner.

In each of the image forming sections 10C, 10M, 10Y, 10K, and 10W that respectively include the image drum units 11C, 11M, 11Y, 11K, and 11W, corresponding one of the toner images having the respective colors is formed by an electrophotographic process as described below.

First, referring to FIG. 2, the surface (the superficial part) of the photosensitive drum 111 is uniformly charged by the charging roller 112. Here, the charging roller 112 is supplied with the applied voltage Va2 from the charging roller power supply 182. Then, the surface of the photosensitive drum 111 is irradiated with the irradiation light L emitted from corresponding one of the exposure units 17C, 17M, 17Y, 17K, and 17W to be subjected to exposure. This forms the electrostatic latent image corresponding to a printing pattern on the photosensitive drum 111.

On the other hand, the feeding roller 114 is in contact with the developing roller 113, and the feeding roller 114 and the developing roller 113 are each rotated at the predetermined circumferential velocity. Here, the feeding roller 114 is supplied with the applied voltage Va4 from the feeding roller power supply 184, and the developing roller 113 is supplied with the applied voltage Va3 from the developing roller power supply 183. Thus, the toner is fed from the feeding roller 114 onto the surface of the developing roller 113.

Then, the toner on the developing roller 113 is charged by factors including friction resulting from contact of the toner regulating member 115 against the developing roller 113. The thickness of the toner layer on the developing roller 113 may be determined by factors including the voltage Va3 applied to the developing roller 113, the voltage Va4 applied to the feeding roller 114, and pressure that pushes the toner regulating member 115 against the developing roller 113 (i.e., the voltage Va5 applied to the toner regulating member 115).

Also, the developing roller 113 is in contact with the photosensitive drum 111. Hence, the supply of the applied voltage Va3 from the developing roller power supply 183 to the developing roller 113 causes the toner to be attached from the developing roller 113 onto the electrostatic latent image on the photosensitive drum 111.

Then, the toner (the toner image) on the photosensitive drum 111 is transferred onto the recording medium 9 by means of an electric field between the photosensitive drum 111 and corresponding one of the transfer members 141C, 141M, 141Y, 141K, and 141W. The toner remaining on the surface of the photosensitive drum 111 is scraped by the cleaning member 116 so that the surface of the photosensitive drum 111 is cleaned.

The toner images having the respective colors are thus formed in the respective image forming sections 10C, 10M, 10Y, 10K, and 10W and are thus transferred, sequentially in the conveying direction "d" described above, onto the recording medium 9 in the above-described manner.

More specifically, in the image forming section 10W illustrated in FIG. 1, the white toner is used to form the underlayer 20*a* of the image layer 21 as schematically illustrated by way of example in FIG. 3. Thereafter, in the image forming sections 10C, 10M, 10Y, and 10K, corresponding one of the toners having the respective colors (the cyan toner, the magenta toner, the yellow toner, and the black toner) is used to form the image layer 21. The thus-formed image layer 21 is a layer configured of the toner images having the respective colors.

In this manner, the image forming apparatus 1 forms the underlayer 21*a* (the white toner image) of the image layer 21 (the color toner images) with use of the white toner. This achieves an effect that, for example, even when the recording medium 9 has a color tone or is made of a transparent material, it is possible to reduce an influence exerted by a ground color of the recording medium 9 by virtue of the underlayer 21*a*, and to improve color development accordingly.

Following the subsequent transferring of the toner images onto the recording medium 9 as described above, the toners (the toner images) on the recording medium 9, conveyed from the transfer belt unit 14, are applied with heat and pressure by the fixing unit 15 to be fixed onto the recording medium 9 as illustrated in FIG. 1. Then, the recording medium 9, onto which the toners are fixed, is discharged to the outside of the image forming apparatus 1 by the discharging roller 16.

[B. Density of White Toner and Suppression of Density Unevenness of White Toner]

In general, the white toner tends to be lower in charge amount (absolute value) than the toners having other colors (the cyan toner, the magenta toner, the yellow toner, and the black toner) even under the application of the same voltage. This is attributable to the use of the metal oxide such as the titanium oxide and the zinc oxide for the white toner colorant as described above. In other words, due to easier emission of charges by the nature of metal oxide, the white toner is low in absolute value of the charge amount as compared with the toner having any other color.

The following is an illustrative numerical example of charge amounts of the toners having the respective colors.

Cyan toner: −49 (μC/g)
Magenta toner: −47 (μC/g)
Yellow toner: −49 (μC/g)
Black toner: −51 (μC/g)
White toner: −24 (μC/g)

For example, the charge amounts of the toners having the respective colors may be measured based on the following measurement method and conditions.

Taking 0.3 grams of a toner and mixing the toner with 9.7 grams of carrier followed by stirring of the toner mixture under a nitrogen gas flow for 10 minutes.

Separating the carrier from the stirred toner mixture with use of a mesh filter having the number of meshes of 400 mesh, and measuring the charge amount of the toner with use of a q/m meter available from Epping GmbH located in Neufahrn, Germany.

On the other hand, because the image forming apparatus 1 forms the underlayer 20*a* of the image layer 21 with use of the white toner as described above, a region in which the toner image of the white toner (the underlayer 20*a*) is formed tends to be relatively wider than the formation region of the toners having other colors. Due to this tendency, it is necessary that that the toner image using the white toner be high in density. In other words, despite being low in charge amount and thus being difficult to increase the density, the toner image using the white toner (the underlayer 20*a*) is required to be high in density.

To address such circumstances, in the image forming apparatus 1 in this example embodiment, the various parameters for the image forming sections 10C, 10M, 10Y, 10K, and 10W, represented in the foregoing (1) to (5), are controlled (set) as described below, instead of, for example, setting the same values for (values common to) those various parameters. In this example embodiment, as described below in greater detail, the values of the various parameters for the image forming section 10W, in which the white toner is used, are controlled to be different from (in one embodiment, to be relatively larger or smaller than) the values of the various parameters for the respective image forming sections 10C, 10M, 10Y, and 10K that use the toners having other colors.

First, as illustrated by way of example in FIG. 6, the density of the toner on the recording medium 9 is largely influenced by the absolute value (|Va3|) of the voltage Va3 applied to the developing roller 113. More specifically, the density of the toner increases (becomes higher) with the increase in the absolute value |Va3| of the applied voltage Va3. However, increasing the absolute value |Va3| of the applied voltage Va3 in the image forming section 10W to be larger than the absolute value |Va3| in any other image forming section 10C, 10M, 10Y, or 10K for increasing the density of the white toner on the recording medium 9 (for making the density of the white toner on the recording medium 9 higher) as described above may lead to the following situations.

Figure 7:
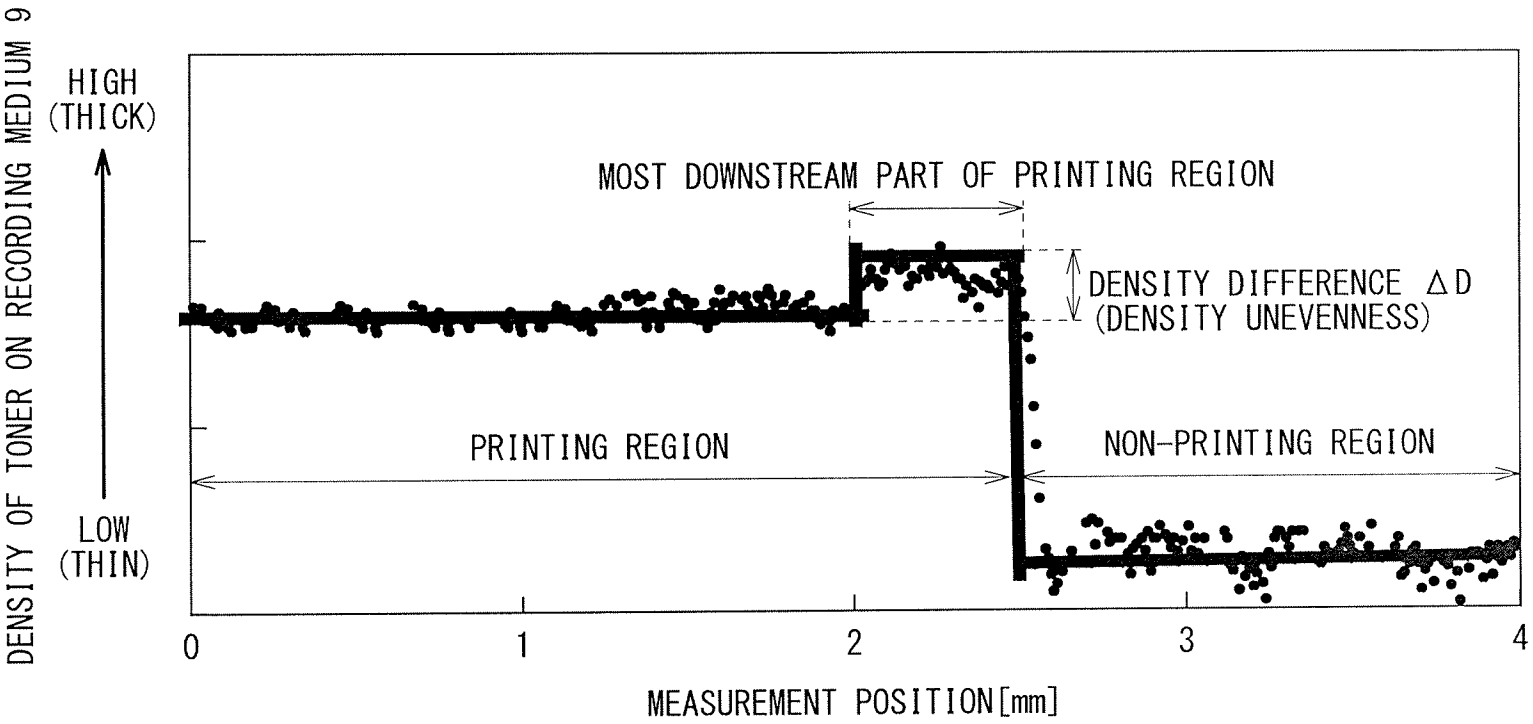
FIG. 7 describes a difference in density (density unevenness) of the toner on the recording medium.

Referring to FIG. 7 by way of example, it is likely that unevenness of toner density (density unevenness) is generated at a most downstream part of a printing region on the recording medium 9. In one example illustrated in FIG. 7, the density of the toner in the most downstream part (corresponding to a portion having a width of about 0.5 mm) is relatively higher than any other part of the printing region, causing the density unevenness arising from a density difference ΔD.

Figure 8:
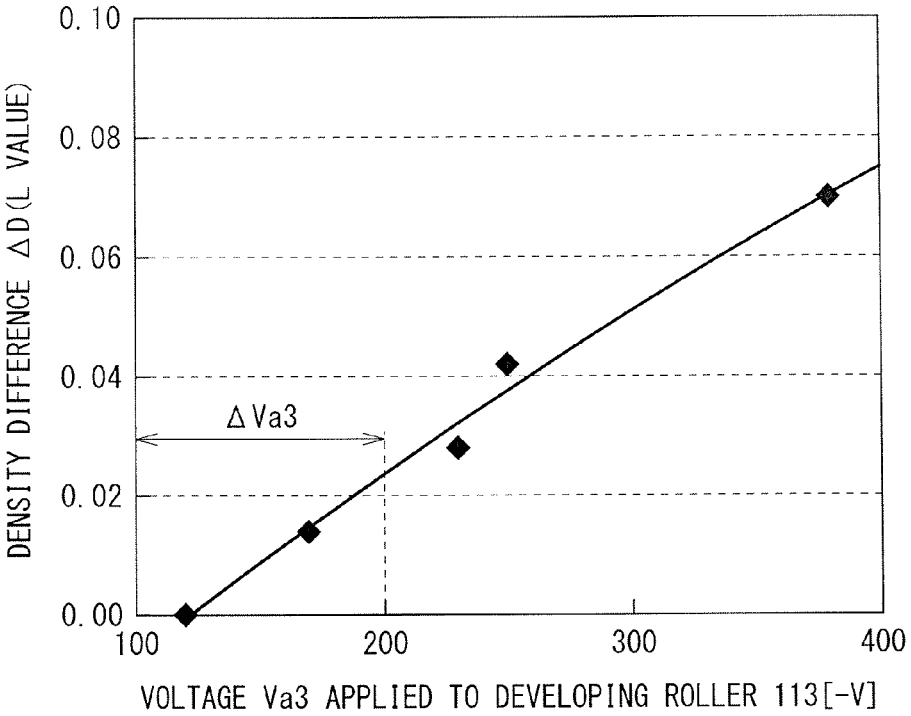
FIG. 8 illustrates an example of a relationship of the voltage applied to the developing roller versus the density difference illustrated in FIG. 7.

Further, referring to FIG. 8 by way of example, such a density difference ΔD (a magnitude of the density unevenness) is largely influenced by the absolute value |Va3| of the voltage Va3 applied to the developing roller 113 as described above. More specifically, the density difference ΔD increases with the increase in the absolute value |Va3| of the applied voltage Va3.

As described, increasing the absolute value |Va3| of the voltage Va3 applied to the developing roller 113 in the image forming section 10W ensures the density of the white toner on the recording medium 9 (i.e., achieves high density of the white toner), but this also increases the density unevenness resulting from the density difference ΔD. On the other hand, decreasing the absolute value |Va3| of the applied voltage Va3 suppresses the density unevenness resulting from the density difference ΔD, but this prevents the density of the white toner on the recording medium 9 from being ensured (i.e., prevents achievement of high density of the white toner). In other words, such a method makes it difficult to achieve both ensuring of the density of the white toner and suppression of the density unevenness together.

For one reason described above, the example embodiment does not employ the method of ensuring the density of the toner on the recording medium 9 by means of the absolute value |Va3| of the voltage Va3 applied to the developing roller 113. Instead, the example embodiment employs methods as described below.

In the example embodiment, as previously illustrated in FIG. 4, the controller 19 so controls the developing roller power supplies 183 in the respective power supply units 18C, 18M, 18Y, 18K, and 18W as to allow the absolute value |Va3(W)| and the absolute value |Va3(C, M, Y, K)| to be substantially equal to each other, i.e., as to satisfy the expression (1a) described above. In one preferred embodiment, the controller 19 may so control the developing roller power supplies 183 as to allow the absolute value |Va3(W)| and the absolute value |Va3(C, M, Y, K)| to be equal to each other, i.e., as to satisfy the expression (1b) described above. In an alternative preferred embodiment, the controller 19 may so control the developing roller power supplies 183 as to allow the absolute value |Va3(W)| to be smaller than the absolute value |Va3(C, M, Y, K)|, i.e., as to satisfy the expression (1c) described above. In one embodiment, the controller 19 may set each of the absolute values |Va3(W)| and |Va3(C, M, Y, K)| to fall within a range ΔVa3 illustrated in FIG. 8 (within a range of the absolute value from about 100 V to about 200 V).

This makes it possible to reduce, or avoid (i.e., make the density unevenness hardly noticeable), the foregoing generation of the density unevenness resulting from the increase in the absolute value |Va3| of the applied voltage Va3 in each of the image forming sections 10C, 10M, 10Y, 10K, and 10W (especially in the image forming section 10W).

Also, instead of employing the method that utilizes the absolute value |Va3| of the voltage Va3 applied to the developing roller 113, the example embodiment may employ a method of ensuring the density of the toner on the recording medium 9 by means of the circumferential velocity Sp3 of the developing roller 113, or by means of the circumferential velocity ratio Rp (=the circumferential velocity Sp3 of the developing roller 113/the circumferential velocity Sp1 of the photosensitive drum 111) as described above.

More specifically, the controller 19 may so control the image drum units 11C, 11M, 11Y, 11K, and 11W as to allow the circumferential velocity Sp3(W) and the circumferential velocity Sp3(C, M, Y, K) to be different from each other as previously illustrated by way of example in FIGS. 4 and 5, i.e., as to satisfy the expression (2a) described above. In one preferred embodiment, the controller 19 may so control the image drum units 11C, 11M, 11Y, 11K, and 11W as to allow the circumferential velocity Sp3(W) to be greater than the circumferential velocity Sp3(C, M, Y, K) as illustrated in FIGS. 4 and 5, i.e., as to satisfy the expression (2b) described above.

In an alternative preferred embodiment, the controller 19 may so control the image drum unit 11W as to allow the circumferential velocity Sp3(W) to fall within a range ΔSp3 from 310 [mm/s] to 380 [mm/s] as illustrated by way of example in FIG. 9, i.e., as to satisfy the expression (2c) described above. One critical significance of 310 [mm/s] as a lower limit of the circumferential velocity Sp3(W), or one reason that the circumferential velocity Sp3(W) of less than the lower limit is undesirable, is that efficiency in development is decreased and thus the density of the toner (an "L" value) becomes less than 82.3 if the circumferential velocity Sp3(W) falls below the lower limit. Also, one critical significance of 380 [mm/s] as an upper limit of the circumferential velocity Sp3(W), or one reason that the circumferential velocity Sp3(W) of greater than the upper limit is undesirable, is that an absolute value of a toner potential on the developing roller 113 is increased to cause easier generation of smear if the circumferential velocity Sp3(W) exceeds the upper limit.

In addition, the controller 19 may so control the image drum units 11C, 11M, 11Y, 11K, and 11W as to allow the circumferential velocity ratio Rp(W) and the circumferential velocity ratio Rp(C, M, Y, K) to be different from each other as previously illustrated by way of example in FIGS. 4 and 5, i.e., as to satisfy the expression (4a) described above. In one preferred embodiment, the controller 19 may so control the image drum units 11C, 11M, 11Y, 11K, and 11W as to allow the circumferential velocity ratio Rp(W) to be greater than the circumferential velocity ratio Rp(C, M, Y, K) as illustrated in FIGS. 4 and 5, i.e., as to satisfy the expression (4b) described above.

In an alternative preferred embodiment, the controller 19 may so control the image drum unit 11W as to allow the circumferential velocity ratio Rp(W) to fall within a range ΔRp from 1.35 to 1.65 as illustrated by way of example in FIG. 10, i.e., as to satisfy the expression (4c) described above. One critical significance of 1.35 (≈(Sp3(W): 310)/(Sp1(W): 230)) as a lower limit of the circumferential velocity ratio Rp(W), or one reason that the circumferential velocity ratio Rp(W) of less than the lower limit is undesirable, is that the efficiency in development is decreased and thus the density of the toner (the "L" value) becomes less than 82.3 if the circumferential velocity ratio Rp(W) falls below the lower limit. Also, one critical significance of 1.65 (≈(Sp3(W): 380)/(Sp1(W): 230)) as an upper limit of the circumferential velocity ratio Rp(W), or one reason that the circumferential velocity ratio Rp(W) of greater than the upper limit is undesirable, is that the absolute value of the toner potential on the developing roller 113 is increased to cause easier generation of smear if the circumferential velocity ratio Rp(W) exceeds the upper limit.

Note that, in the example embodiment, the controller 19 so controls the image drum units 11C, 11M, 11Y, 11K, and 11W as to allow the circumferential velocity Sp1(W) and the circumferential velocity Sp1(C, M, Y, K) to be substantially equal to each other as illustrated by way of example in FIGS. 4 and 5, i.e., as to satisfy the expression (3a) described above. In one preferred embodiment, the controller 19 may so control the image drum units 11C, 11M, 11Y, 11K, and 11W as to allow the circumferential velocity Sp1(W) and the circumferential velocity Sp1(C, M, Y, K) to be equal to each other as illustrated in FIGS. 4 and 5, i.e., as to satisfy the expression (3b) described above. One reason why the values are controlled to be the same among (common to) the image drum units 11C, 11M, 11Y, 11K, and 11W for the circumferential velocities Sp1 of the respective photosensitive drums 111 is that, if the circumferential velocity Sp1 is varied between the photosensitive drums 111, troubles including, without limitation, an inappropriate conveying operation of the recording medium 9 may occur.

In this manner, in the example embodiment, the controller 19 controls the circumferential velocity Sp3 or the circumferential velocity ratio Rp in each of the image forming sections 10C, 10M, 10Y, 10K, and 10W as described above. This achieves an effect that the density of the white toner on the recording medium 9 is ensured (i.e., it is possible to achieve high density) without increasing more than necessary the absolute value |Va3| of the voltage Va3 applied to the developing roller 113 (i.e., while suppressing the increase in the absolute value |Va3|). In other words, it is possible to achieve both the ensuring of the density of the white toner and the suppression of the density unevenness together.

Note that, unlike the image forming section 10W corresponding to the white toner as described above, it is possible to ensure sufficiently high densities for the toners having the respective colors other than the white toner in the image forming sections 10C, 10M, 10Y, and 10K that correspond to the toners having the respective colors other than white as illustrated in FIGS. 4 and 5 described above, even when the absolute value |Va3| of the voltage Va3 applied to the developing roller 113 is kept small. Hence, the circumferential velocity Sp3 or the circumferential velocity ratio Rp may be controlled to be relatively smaller in each of the image forming sections 10C, 10M, 10Y, and 10K than the circumferential velocity Sp3 or the circumferential velocity ratio Rp in the image forming section 10W, in terms of suppressing a deterioration in material property of the toner attributed to factors including, without limitation, frictional heat.

[C. Suppression of Image Quality Deterioration Due to Control of Circumferential Velocity or Circumferential Velocity Ratio]

In the image forming section 10W, causing the circumferential velocity Sp3 or the circumferential velocity ratio Rp to be high more than necessary may result in occurrence of deterioration in image quality as described below.

Figure 11:
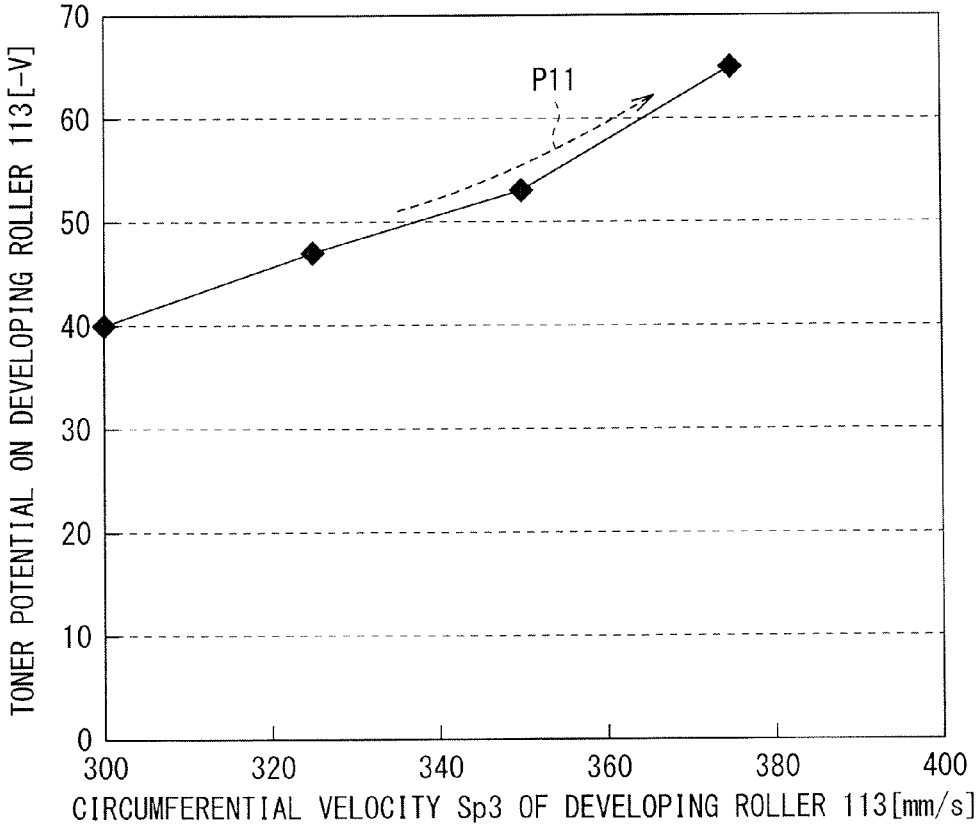
FIG. 11 illustrates an example of a relationship of the circumferential velocity of the developing roller versus a toner potential on the developing roller.
Figure 12:
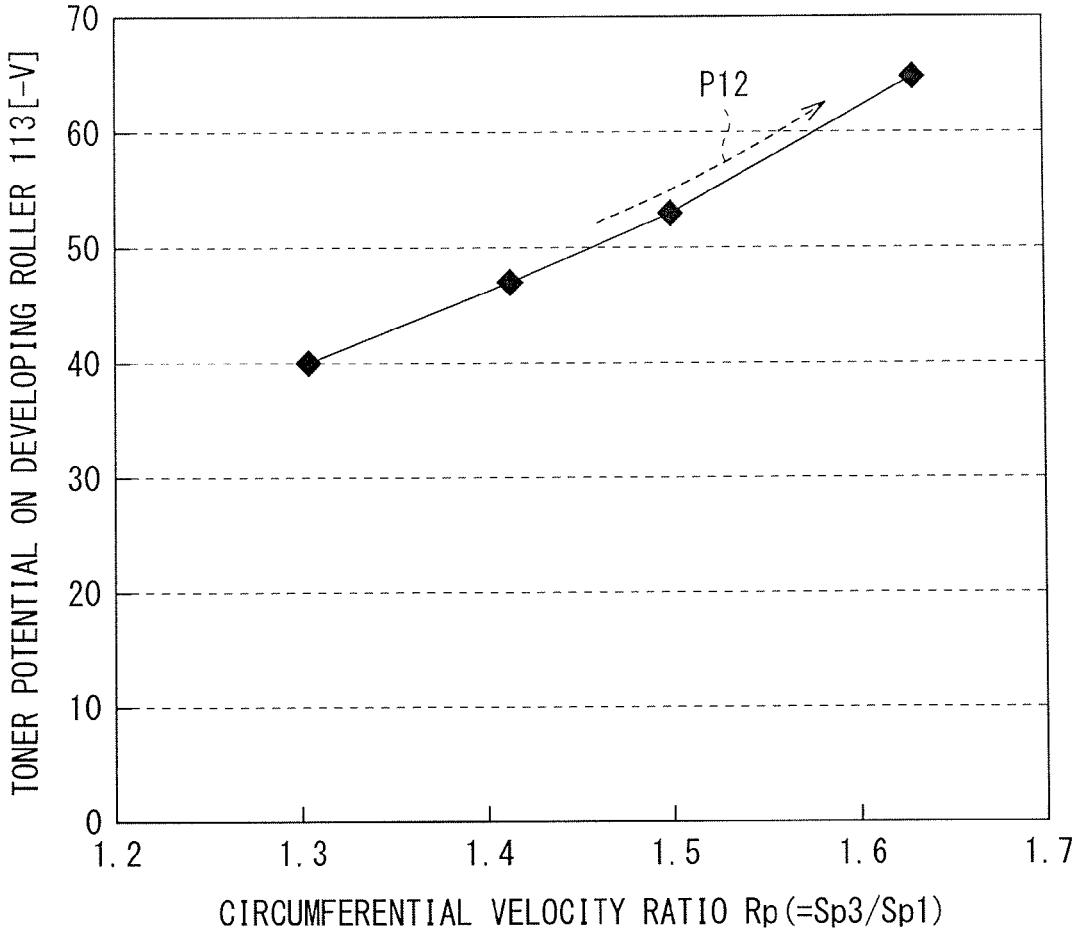
FIG. 12 illustrates an example of a relationship of the circumferential velocity ratio versus the toner potential on the developing roller.

Referring by way of example to FIGS. 11 and 12, the toner potential (the absolute value) on the developing roller 113 increases with the increase in the circumferential velocity Sp3 of the developing roller 113 as denoted by arrows P11 and P12. Such an increase in the absolute value of the toner potential on the developing roller 113 may result in easier occurrence of the image quality deterioration such as, but not limited to, a decrease in dot reproducibility and generation of smear.

To address such circumstances, in the example embodiment, a magnitude of the absolute value |Va5| of the voltage Va5 applied to the toner regulating member 115 may be controlled to suppress (reduce or avoid) the image quality deterioration resulting from the increase in the circumferential velocity Sp3 or the circumferential velocity ratio Rp.

More specifically, the controller 19 may so control the toner regulating member power supplies 185 in the respective power supply units 18C, 18M, 18Y, 18K, and 18W as to allow the absolute value |Va5(W)| and the absolute value |Va5(C, M, Y, K)| to be different from each other as illustrated in FIGS. 4 and 5, i.e., as to satisfy the expression (5a) described above. In one preferred embodiment, the controller 19 may so control the toner regulating member power supplies 185 as to allow the absolute value |Va5(W)| to be smaller than the absolute value |Va5(C, M, Y, K)| as illustrated in FIGS. 4 and 5, i.e., as to satisfy the expression (5b) described above.

In this manner, in the example embodiment, the controller 19 may control the absolute value |Va5| of the voltage Va5 applied to the toner regulating member 115 in each of the image forming sections 10C, 10M, 10Y, 10K, and 10W as described above. This achieves an effect that the increase in the absolute value of the toner potential in the white toner on the developing roller 113 is suppressed in the image forming section 10W, making it possible to suppress (reduce or avoid) the image quality deterioration resulting from the increase in the circumferential velocity Sp3 or the circumferential velocity ratio Rp as described above.

Figure 13:
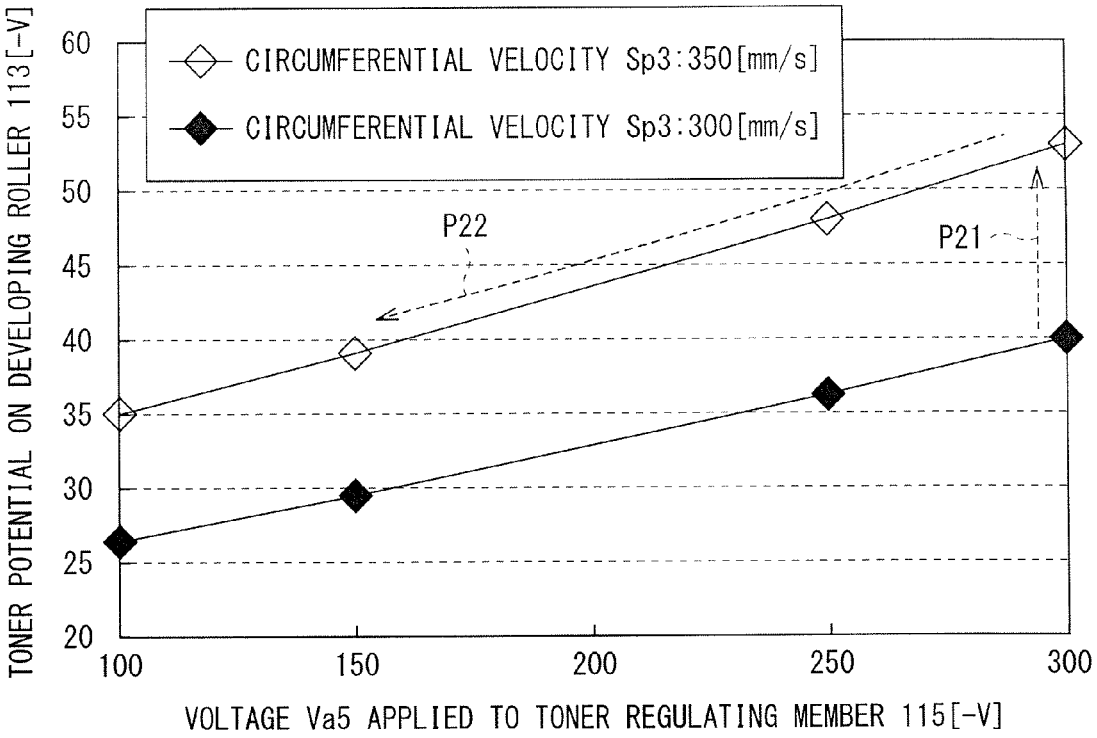
FIG. 13 illustrates an example of a relationship of a voltage applied to a toner regulating member versus the toner potential on the developing roller, where the circumferential velocity of the developing roller is varied.
Figure 14:
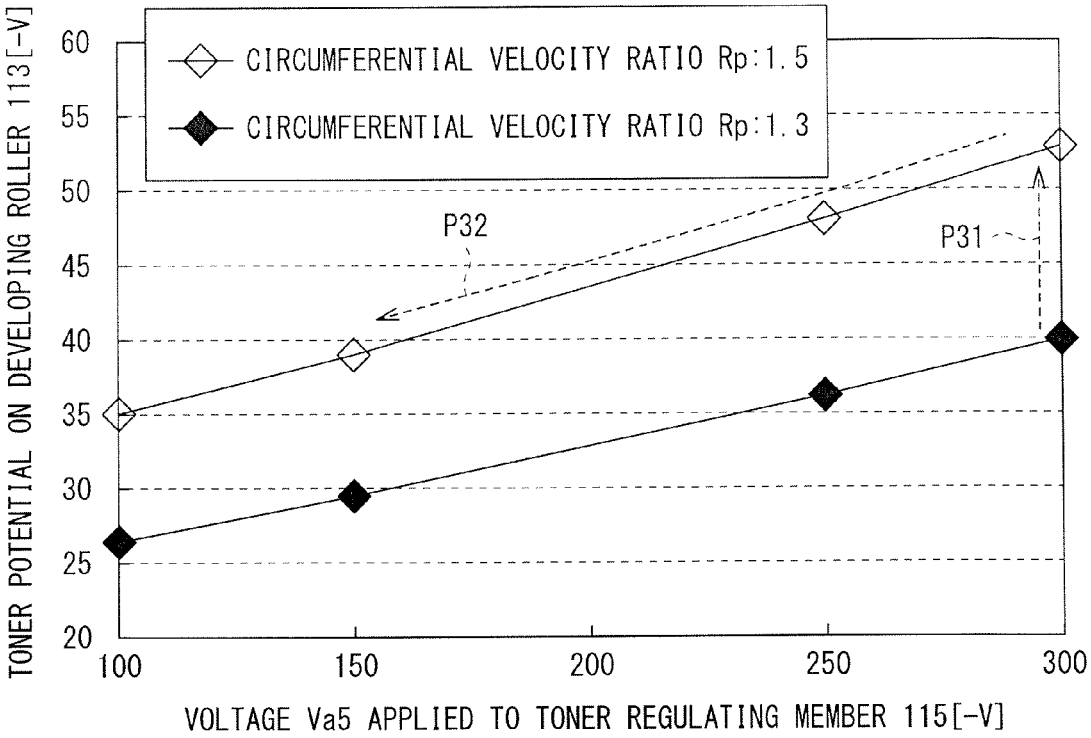
FIG. 14 illustrates an example of a relationship of the voltage applied to the toner regulating member versus the toner potential on the developing roller, where the circumferential velocity ratio is varied.

More specifically, even when the circumferential velocity Sp3 or the circumferential velocity ratio Rp is increased in the image forming section 10W for suppressing the above-described density unevenness as illustrated by way of example in FIGS. 13 and 14 (see arrows P21 and P31), it is possible to suppress the increase in the absolute value of the toner potential in the white toner on the developing roller 113 by making the absolute value |Va5| of the voltage Va5 applied to the toner regulating member 115 small (see arrows P22 and P32). It is therefore clear that the image quality deterioration resulting from the increase in the circumferential velocity Sp3 or the circumferential velocity ratio Rp is suppressed (reduced or avoided), while suppressing the density unevenness described above.

[D. Relationship Between Amount of Fogging Toner and Amount of Smearing Toner]

Figure 15:
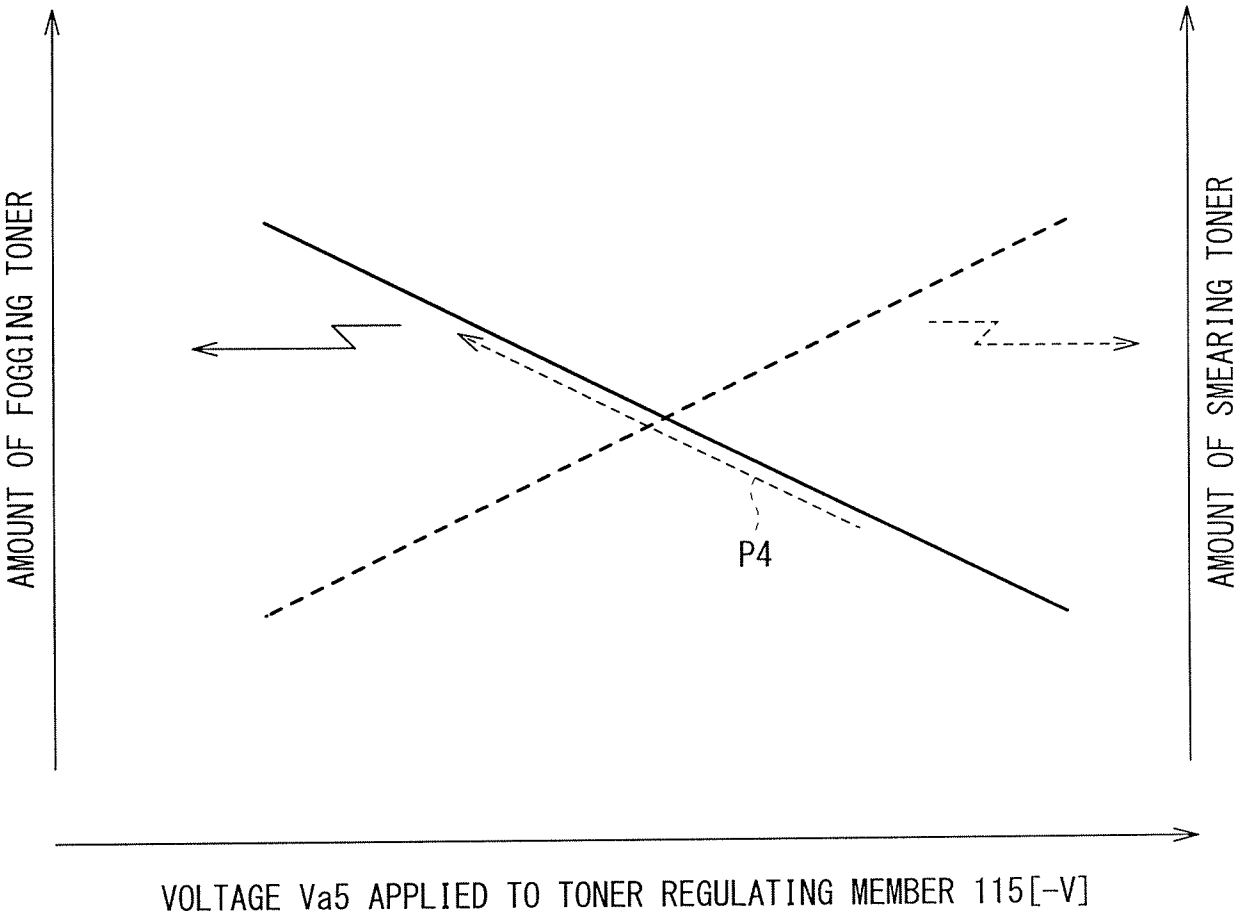
FIG. 15 schematically illustrates an example of a relationship of the voltage applied to the toner regulating member versus an amount of fogging toner and an amount of smearing toner.

On the other hand, suppressing the absolute value |Va5| of the voltage Va5 applied to the toner regulating member 115 to be excessively small may result in an increase in a so-called "fogging toner" (an increase in an amount of the fogging toner) formed on the photosensitive drum 111 as schematically illustrated by way of example in FIG. 15 (see an arrow P4), and may thus result in easier occurrence of image quality deterioration (occurrence of so-called "fogging").

As used herein, the term "fogging" refers to a phenomenon in which a toner is attached to a background part of an image, i.e., to a non-image part (a non-printing region) as a result of, for example, a toner relatively lower in a charge amount than a toner properly charged or a toner charged to a polarity reverse to a proper polarity. Also, the term "fogging toner" refers to the toner that causes the fogging, such as the toner having the low charge amount or charged to the reverse polarity described above.

However, causing the absolute value |Va5| of the voltage Va5 applied to the toner regulating member 115 to be excessively large may result in an increase in a so-called "smearing toner" (an increase in an amount of the smearing toner) formed on the photosensitive drum 111 as again schematically illustrated by way of example in FIG. 15, and may thus result in easier occurrence of image quality deterioration (occurrence of so-called "smearing").

As used herein, the term "smearing" refers to a phenomenon in which a toner is attached to the background part (the non-image part or the non-printing region) of the image as described above as a result of, for example, a toner relatively higher in a charge amount than the toner properly charged, i.e., a so-called excessively-charged toner. Also, the term "smearing toner" refers to the toner that causes the smearing, such as the excessively-charged toner described above.

In view of suppressing the image quality deterioration resulting from the "fogging" and the "smearing", it is preferable that the absolute value |Va5| of the voltage Va5 applied to the toner regulating member 115 be controlled within a range appropriate in magnitude without being excessively small or excessively large.

In the foregoing example embodiment, the controller 19 controls the parameters represented in (1) to (5) described above in a manner illustrated by way of example in FIG. 4 and other drawings. This makes it possible to achieve effects including, without limitation, the achievement of both the ensuring of the density of the white toner and the suppression of the density unevenness together, and the suppression of the image quality deterioration resulting from the increase in the circumferential velocity Sp3 or the circumferential velocity ratio Rp. Hence, it is possible to achieve a favorable image (or to improve image quality) in the image forming apparatus 1 that uses the white toner.

Note that, in one embodiment illustrated in FIG. 5 (the numerical examples of the various parameters) described above, the absolute value |Va3(W)| of the voltage Va3(W) applied to the developing roller 113 is set to a small value, i.e., 200 V, for suppressing the density unevenness as the highest priority in the image forming section 10W. Also, the resulting decrease in the density of the white toner on the recording medium 9 is covered by increasing the value of the circumferential velocity Sp3(W) or the circumferential velocity ratio Rp(W). The increase in the absolute value of the toner potential in the white toner on the developing roller 113 (the image quality deterioration described above), resulting from the increase in the value of the circumferential velocity Sp3(W) or the circumferential velocity ratio Rp(W), is suppressed by keeping the absolute value |Va5(W)| of the voltage Va5(W) applied to the toner regulating member 115 small.

2. MODIFICATION EXAMPLES

Hereinafter, a description is given of some modification examples (first and second modification examples) of the example embodiment described above. Note that the same or equivalent elements as those of the example embodiment are denoted with the same reference numerals, and will not be described in detail.

First Modification Example

FIG. 16 illustrates, in table, an example of controlling of (a setting example of) various parameters performed by the controller 19 in the first modification example for each of the image forming sections 10C, 10M, 10Y, 10K, and 10W. As in FIGS. 4 and 5 in the example embodiment described above, the parameters represented in (1) to (5) described above are given as an example of the various parameters controlled by the controller 19 in the first modification example.

Referring to FIG. 16, the controller 19 in the first modification example performs the following control on a part of the parameters represented in (1) to (5) described above. More specifically, unlike the controller 19 described in the example embodiment, the controller 19 so performs a control that a relationship in magnitude of the various parameters in the example embodiment described above is reversed for the following parameters represented in the (2), (4), and (5). Otherwise, the controller 19 in the first modification example performs the same control as the example embodiment for the parameters represented in (1) and (3).

(2) Control of Circumferential Velocity Sp3

As with the example embodiment, the controller 19 so controls the image drum units 11C, 11M, 11Y, 11K, and 11W as to allow the circumferential velocity Sp3(W) and the circumferential velocity Sp3(C, M, Y, K) to be different from each other as illustrated in FIG. 16, i.e., as to satisfy the expression (2a) described above. However, unlike the example embodiment, the controller 19 so controls the image drum units 11C, 11M, 11Y, 11K, and 11W as to allow the circumferential velocity Sp3(W) to be less than the circumferential velocity Sp3(C, M, Y, K) as illustrated in FIG. 16, i.e., as to satisfy the following expression (2d) in the first modification example.

$$Sp3(W) \neq Sp3(C,M,Y,K) \tag{2a}$$

$$Sp3(W) < Sp3(C,M,Y,K) \tag{2d}$$

In the first modification example, the control is so performed as to satisfy the expression (2a) described above. Hence, it is also possible for the first modification example to achieve effects similar to the example effects achieved by the example embodiment described above, by virtue of operations similar thereto.

(4) Control of Circumferential Velocity Ratio Rp (=Sp3/Sp1)

As with the example embodiment, the controller 19 may so control the image drum units 11C, 11M, 11Y, 11K, and 11W as to allow the circumferential velocity ratio Rp(W) and the circumferential velocity ratio Rp(C, M, Y, K) to be different from each other as illustrated in FIG. 16, i.e., as to satisfy the expression (4a) described above. However, unlike the example embodiment, the controller 19 may so control the image drum units 11C, 11M, 11Y, 11K, and 11W as to allow the circumferential velocity ratio Rp(W) to be less than the circumferential velocity ratio Rp(C, M, Y, K) as illustrated in FIG. 16, i.e., as to satisfy the following expression (4d) in the first modification example.

$$Rp(W) \neq Rp(C,M,Y,K) \tag{4a}$$

$$Rp(W) < Rp(C,M,Y,K) \tag{4d}$$

In the first modification example, the control may be so performed as to satisfy the expression (4a) described above. Hence, it is also possible for the first modification example to achieve effects similar to the example effects achieved by the example embodiment, by virtue of operations similar thereto.

(5) Control of Absolute Value |Va5|

As with the example embodiment, the controller 19 may so control the toner regulating member power supplies 185 in the respective power supply units 18C, 18M, 18Y, 18K, and 18W as to allow the absolute value |Va5(W)| and the absolute value |Va5(C, M, Y, K)| to be different from each other as illustrated in FIG. 16, i.e., as to satisfy the expression (5a) described above. However, unlike the example embodiment, the controller 19 may so control the toner regulating member power supplies 185 as to allow the absolute value |Va5(W)| to be larger than the absolute value |Va5(C, M, Y, K)| as illustrated in FIG. 16, i.e., as to satisfy the following expression (5c) in the first modification example.

$$|Va5(W)| \neq |Va5(C,M,Y,K)| \tag{5a}$$

$$|Va5(W)| > |Va5(C,M,Y,K)| \tag{5c}$$

In the first modification example, the control may be so performed as to satisfy the expression (5a) described above. Hence, it is also possible for the first modification example to achieve effects similar to the example effects achieved by the example embodiment, by virtue of operations similar thereto.

Second Modification Example

Figure 17:
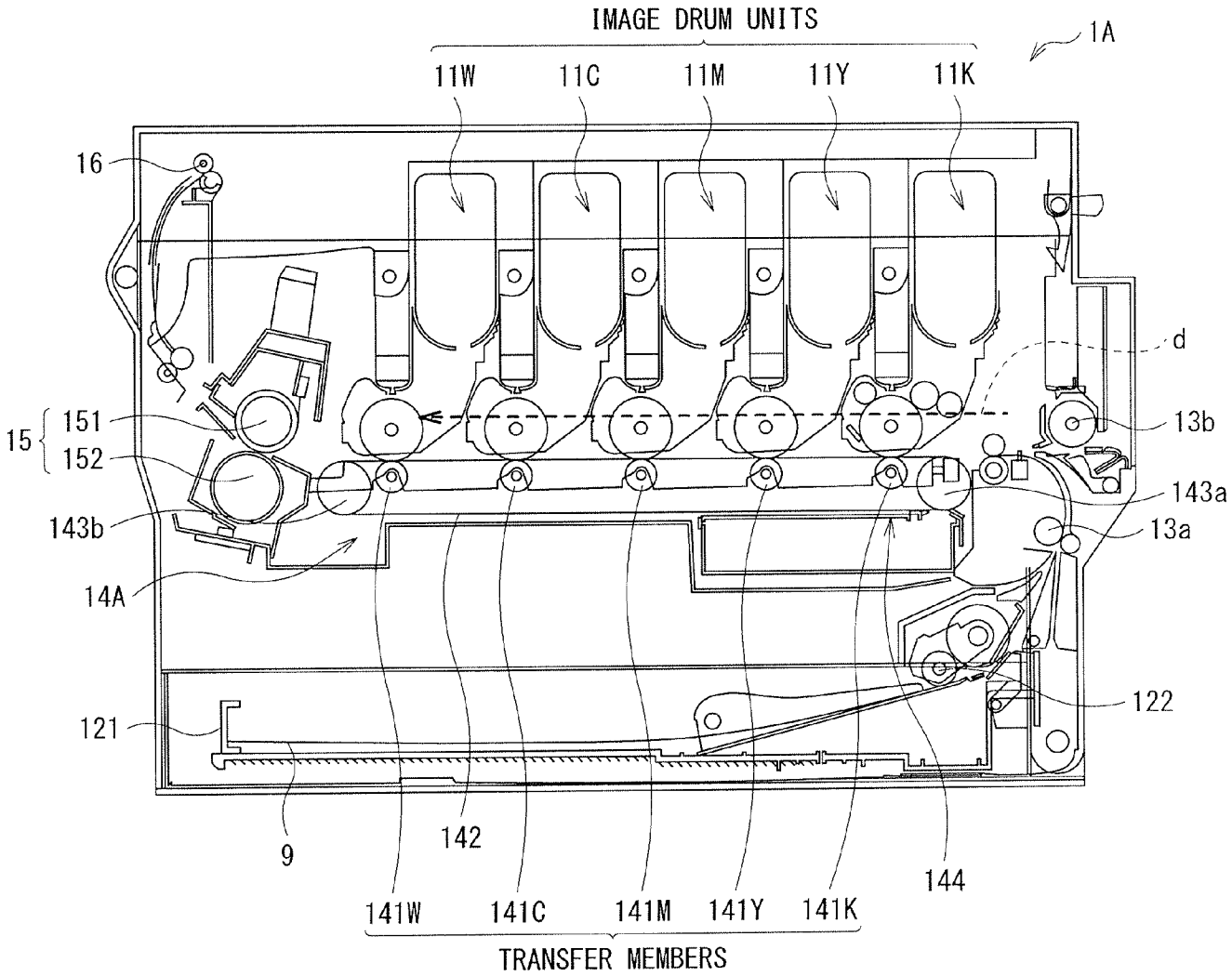
FIG. 17 schematically illustrates an example of an outline configuration of an image forming apparatus according to a second modification example.

FIG. 17 schematically illustrates an example of an outline configuration of an image forming apparatus (an image forming apparatus 1A) according to the second modification example. The image forming apparatus 1A in the second modification example has a configuration similar to the configuration of the image forming apparatus 1 in the example embodiment illustrated in FIGS. 1 and 2, with the exception that the order of arrangement of the image forming sections 10C, 10M, 10Y, 10K, and 10W is partially changed.

Referring to FIG. 17, in the image forming apparatus 1A, the image drum units 11C, 11M, 11Y, 11K, and 11W are disposed side by side in order of the image drum units 11K, 11Y, 11M, 11C, and 11W in the conveying direction "d" of the recording medium 9 (from the upstream side to the downstream side).

Also, the transfer belt unit 14A in the second modification example differs from the transfer belt unit 14 in the example embodiment, in that the order of arrangement of the transfer members 141C, 141M, 141Y, 141K, and 141W is partially changed in accordance with the disposed order of the image drum units 11K, 11Y, 11M, 11C, and 11W as described above. More specifically, in the transfer belt unit 14A, the transfer members 141C, 141M, 141Y, 141K, and 141W are disposed side by side in order of the transfer members 141K, 141Y, 141M, 141C, and 141W in the conveying direction "d" of the recording medium 9, as illustrated in FIG. 17.

In the image forming apparatus 1A according to the second modification example having the foregoing arrangement and configuration, the various parameters described above may be set (controlled) in a manner similar to the example embodiment or the first modification example described above. Hence, it is possible for the second modification example to achieve effects similar to the example effects achieved by the example embodiment or the first modification example, by virtue of operations similar thereto basically.

In particular, in the second modification example, the order of arrangement of the image forming sections 10C, 10M, 10Y, 10K, and 10W is partially changed, i.e., the image forming section 10W is disposed on the most downstream side, making it possible to achieve the following example effects unlike the example embodiment and the first modification example.

Figure 18:
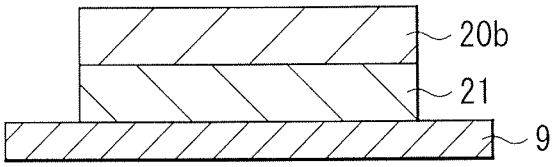
FIG. 18 schematically illustrates an example of a cross-sectional configuration of an image layer and an overcoat layer formed by the image forming apparatus illustrated in FIG. 17.

Referring by way of example to a schematic cross-sectional view in FIG. 18, the image forming section 10W in the image forming apparatus 1A according to the second modification example uses the white toner and forms an overcoat layer 20*b* of the image layer 21. The overcoat layer 20*b* is formed as an upper layer of the image layer 21 that is formed on or immediately above the recording medium 9, and functions as the auxiliary layer as with the underlayer 20*a*. For example, the image forming apparatus 1A may be used for an application in which the image layer 21 is peeled off together with the overcoat layer 20*b* from the recording medium 9, following which the image layer 21 and the overcoat layer 20*b* are turned upside down (i.e., so that the overcoat layer 20*b* serves as an underlayer) to attach the overcoat layer 20*b*, together with the image layer 21, to another medium, such that the image layer 21 and the overcoat layer 20*b* as a whole serve as a sticker to be attached to another medium. Hence, as with the example embodiment and the first modification example described above, the second modification example makes it possible to reduce an influence exerted by a ground color of the recording medium 9 that may, for example, have a color tone or may be made of a transparent material, and to improve color development accordingly, even for such an application example described above.

Note that the overcoat layer 20*b* in the second modification example is also the monochrome layer in white (the white layer) as with the underlayer 20*a*. In one embodiment of the invention, the overcoat layer 20*b* corresponds to a concrete but non-limiting example of the "auxiliary layer", the "monochrome layer", or the "white layer".

3. OTHER MODIFICATION EXAMPLES

Although the invention has been described in the foregoing by way of example with reference to the example embodiment and the modification examples, the invention is not limited thereto but may be modified in a wide variety of ways.

For example, although a description has been given of the example embodiment and the modification examples with specific reference to the configuration (such as a shape, arrangement, and the number) of each member in the image forming apparatus, the configuration including a shape, arrangement, and the number of each member in each of the example embodiment and the modification examples is non-limiting. In other modification examples, factors of the configuration, including a shape, arrangement, and the number of each member, may be different from those described above. In addition, the values, the magnitude relationship, etc., of the various parameters described in the example embodiment and the modification examples are non-limiting. In other modification examples, the values, the magnitude relationship, etc., of the various parameters may be controlled to be different from those described above.

Also, a description has been given of the example embodiment and the modification examples in which the underlayer 20*a* and the overcoat layer 20*b* are each a monochrome layer that serves as a white layer. However, the underlayer 20*a* and the overcoat layer 20*b* are not limited thereto, and may each be a monochrome layer other than the white layer in other modification examples. Non-limiting examples of such a monochrome layer may include a layer in a metallic color and a layer in a cream color. In such other modification examples, an image forming section (an image drum unit) that uses a monochrome toner (a monochrome developer) in any color other than white may be provided in the image forming apparatus in place of the image forming section 10W (the image drum unit 11W).

Further, a description has been given of the example embodiment and the modification examples in which the underlayer 20*a* and the overcoat layer 20*b* each correspond to a concrete but non-limiting example of the "auxiliary layer" (the layer that has an auxiliary function for formation of the image layer 21) in one embodiment of the invention. However, the auxiliary layer is not limited to the underlayer 20*a* or the overcoat layer 20*b*. In other modification examples, a layer other than the underlayer 20*a* and the overcoat layer 20*b* may serve as the "auxiliary layer" in one embodiment of the invention.

In addition, a description has been given of the example embodiment and the modification examples in which a plurality of image forming sections (second image forming sections) that form the image layer 21 are provided (four image forming sections 10C, 10M, 10Y, and 10K are provided). However, factors including the number of image forming sections for forming the image layer 21 and a combination of colors of the toners used for those image forming sections are non-limiting, and may be set on an as-needed basis depending on applications and purposes. In other modification examples, a single image forming section that forms the image layer 21 may be provided to form the image layer 21 as a monochrome image. In other words, the image forming apparatus may function as a monochrome printer.

Further, a description has been given of the example embodiment and the modification examples in which the circumferential velocity Sp1 of the photosensitive drum 111 corresponds to a concrete but non-limiting example of the "traveling velocity of the surface" of "the image supporting member" in one embodiment of the invention, and the circumferential velocity Sp3 of the developing roller 113 corresponds to a concrete but non-limiting example of the "traveling velocity of the surface" of "the developer supporting member" in one embodiment of the invention. However, the wording "traveling velocity of the surface" is not limited to the circumferential velocity Sp1 of the photosensitive drum 111 or the circumferential velocity Sp3 of the developing roller 113. Any of the example embodiment, modification examples, and other modification examples described above is applicable not only to a supporting member that has a shape of a drum or a roller, but also to a supporting member that has any other shape such as, but not limited to, a belt shape.

Moreover, a description has been given of the example embodiment and the modification examples in which the electrostatic latent image corresponds to a concrete but non-limiting example of the "latent image" in one embodiment of the invention. However, the term "latent image" is not limited to the electrostatic latent image. Any of the example embodiment, modification examples, and other modification examples described above is applicable to an application where a latent image other than the electrostatic latent image is used.

Also, a description has been given of the example embodiment and the modification examples in which the image forming apparatus that functions as a printer corresponds to a concrete but non-limiting example of the "image forming apparatus" in one embodiment of the invention. However, the term "image forming apparatus" is not limited to the printer. Any of the example embodiment, modification examples, and other modification examples described above is applicable to any other image forming apparatus. Non-limiting examples of such an image forming apparatus may include, without limitation, a facsimile, a copying machine, and a multi-function peripheral.

Furthermore, the invention encompasses any possible combination of some or all of the various embodiments and the modification examples described herein and incorporated herein.

It is possible to achieve at least the following configurations from the above-described example embodiments of the invention.

(1) An image forming apparatus, including:

a first image forming section including an image supporting member and a developer supporting member, and configured to form an auxiliary layer, the image supporting member being configured to support a latent image on a surface thereof, and the developer supporting member being configured to support, on a surface thereof, a developer that is to be supplied to the image supporting member and allows the latent image to be developed;

a second image forming section including an image supporting member and a developer supporting member, and configured to form an image layer, the image supporting member being configured to support a latent image on a surface thereof, and the developer supporting member being configured to support, on a surface thereof, a developer that is to be supplied to the image supporting member and allows the latent image to be developed; and a controller configured to control the first image forming section and the second image forming section to allow a first velocity and a second velocity to be different from each other, the first velocity being a traveling velocity of the surface of the developer supporting member in the first image forming section, and the second velocity being a traveling velocity of the surface of the developer supporting member in the second image forming section.

(2) The image forming apparatus according to (1), wherein the controller controls the first image forming section and the second image forming section to allow the first velocity to be greater than the second velocity.

(3) An image forming apparatus, including:

a first image forming section including an image supporting member and a developer supporting member, and configured to form an auxiliary layer, the image supporting member being configured to support a latent image on a surface thereof, and the developer supporting member being configured to support, on a surface thereof, a developer that is to be supplied to the image supporting member and allows the latent image to be developed;

a second image forming section including an image supporting member and a developer supporting member, and configured to form an image layer, the image supporting member being configured to support a latent image on a surface thereof, and the developer supporting member being configured to support, on a surface thereof, a developer that is to be supplied to the image supporting member and allows the latent image to be developed; and a controller configured to control the first image forming section and the second image forming section to allow a first velocity ratio and a second velocity ratio to be different from each other, the first velocity ratio being a ratio of a traveling velocity of the surface of the developer supporting member to a traveling velocity of the surface of the image supporting member in the first image forming section, and the second velocity ratio being a ratio of a traveling velocity of the surface of the developer supporting member to a traveling velocity of the surface of the image supporting member in the second image forming section.

(4) The image forming apparatus according to (3), wherein the controller controls the first image forming section and the second image forming section to allow the first velocity ratio to be greater than the second velocity ratio.

(5) The image forming apparatus according to any one of (1) to (4), wherein the first image forming section and the second image forming section each further include a developer regulating member and a first power supply section, the developer regulating member being configured to be in contact with the surface of the developer supporting member to form a layer of the developer on the surface of the developer supporting member, and the first power supply section being configured to apply a voltage to the developer regulating member, and the controller controls the first power supply sections to allow a first voltage value and a second voltage value to be different from each other, the first voltage value being an absolute value of the voltage applied to the developer regulating member in the first image forming section, and the second voltage value being an absolute value of the voltage applied to the developer regulating member in the second image forming section.

(6) The image forming apparatus according to (5), wherein the controller controls the first power supply sections to allow the first voltage value to be smaller than the second voltage value.

(7) The image forming apparatus according to any one of (1) to (6), wherein the first image forming section and the second image forming section each further include a second power supply section configured to apply a voltage to the developer supporting member, and the controller controls the second power supply sections to allow an absolute value of the voltage applied to the developer supporting member in the first image forming section to be smaller than an absolute value of the voltage applied to the developer supporting member in the second image forming section.

(8) The image forming apparatus according to any one of (1) to (7), wherein the auxiliary layer is a monochrome layer.

(9) The image forming apparatus according to (8), wherein the monochrome layer is a white layer.

(10) The image forming apparatus according to any one of (1) to (9), wherein the auxiliary layer is one of an underlayer of the image layer and an overcoat layer of the image layer.

(11) The image forming apparatus according to any one of (1) to (10), wherein the first image forming section uses a white developer as the developer to form the auxiliary layer, and the second image forming section uses a monochrome developer as the developer to form the image layer, the monochrome developer having a color other than white.

(12) An image forming apparatus, including:

a first image forming section including an image supporting member, a developer supporting member, a developer regulating member, and a power supply section, and configured to form an auxiliary layer, the image supporting member being configured to support a latent image on a surface thereof, the developer supporting member being configured to support, on a surface thereof, a developer that is to be supplied to the image supporting member and allows the latent image to be developed, the developer regulating member being configured to be in contact with the surface of the developer supporting member to form a layer of the developer on the surface of the developer supporting member, and the power supply section being configured to apply a voltage to the developer regulating member;

a second image forming section including an image supporting member, a developer supporting member, a developer regulating member, and a power supply section, and configured to form an image layer, the image supporting member being configured to support a latent image on a surface thereof, the developer supporting member being configured to support, on a surface thereof, a developer that is to be supplied to the image supporting member and allows the latent image to be developed, the developer regulating member being configured to be in contact with the surface of the developer supporting member to form a layer of the developer on the surface of the developer supporting member, and the power supply section being configured to apply a voltage to the developer regulating member; and a controller configured to control the power supply sections to allow a first voltage value and a second voltage value to be different from each other, the first voltage value being an absolute value of the voltage applied to the developer regulating member in the first image forming section, and the second voltage value being an absolute value of the voltage applied to the developer regulating member in the second image forming section.

(13) The image forming apparatus according to (12), wherein the controller controls the power supply sections to allow the first voltage value to be smaller than the second voltage value.

(14) The image forming apparatus according to (1), wherein the first image forming section uses a white developer as the developer to form the auxiliary layer, and the controller controls the first image forming section to allow the first velocity to be in a range from 310 mm/s to 380 mm/s.

(15) The image forming apparatus according to (3), wherein the first image forming section uses a white developer as the developer to form the auxiliary layer, and the controller controls the first image forming section to allow the first velocity ratio to be in a range from 1.35 to 1.65.

(16) An image forming apparatus, including:

an image forming section including an image supporting member and a developer supporting member, the image supporting member being configured to support a latent image on a surface thereof, and the developer supporting member being configured to support, on a surface thereof, a white developer that is to be supplied to the image supporting member and allows the latent image to be developed; and a controller configured to control the image forming section to allow a traveling velocity of the surface of the developer supporting member to be in a range from 310 mm/s to 380 mm/s.

(17) An image forming apparatus, including:

an image forming section including an image supporting member and a developer supporting member, the image supporting member being configured to support a latent image on a surface thereof, and the developer supporting member being configured to support, on a surface thereof, a white developer that is to be supplied to the image supporting member and allows the latent image to be developed; and a controller configured to control the image forming section to allow a velocity ratio to be in a range from 1.35 to 1.65, the velocity ratio being a ratio of a traveling velocity of the surface of the developer supporting member to a traveling velocity of the surface of the image supporting member.

Although the invention has been described in terms of exemplary embodiments, it is not limited thereto. It should be appreciated that variations may be made in the described embodiments by persons skilled in the art without departing from the scope of the invention as defined by the following claims. The limitations in the claims are to be interpreted broadly based on the language employed in the claims and not limited to examples described in this specification or during the prosecution of the application, and the examples are to be construed as non-exclusive. For example, in this disclosure, the term "preferably", "preferred" or the like is non-exclusive and means "preferably", but not limited to. The use of the terms first, second, etc. do not denote any order or importance, but rather the terms first, second, etc. are used to distinguish one element from another. The term "substantially" and its variations are defined as being largely but not necessarily wholly what is specified as understood by one of ordinary skill in the art. The term "about" or "approximately" as used herein can allow for a degree of variability in a value or range. Moreover, no element or component in this disclosure is intended to be dedicated to the public regardless of whether the element or component is explicitly recited in the following claims.

What is claimed is:

1. An image forming apparatus, comprising:

a first image forming section including an image supporting member and a developer supporting member, and configured to form an auxiliary layer, the image supporting member being configured to support a latent image on a surface thereof, and the developer supporting member being configured to support, on a surface thereof, a developer that is to be supplied to the image supporting member and allows the latent image to be developed;

a second image forming section including an image supporting member and a developer supporting member, and configured to form an image layer, the image supporting member being configured to support a latent image on a surface thereof, and the developer supporting member being configured to support, on a surface thereof, a developer that is to be supplied to the image supporting member and allows the latent image to be developed; and a controller configured to control the first image forming section and the second image forming section to allow a first velocity and a second velocity to be different from each other, the first velocity being a traveling velocity of the surface of the developer supporting member in the first image forming section, and the second velocity being a traveling velocity of the surface of the developer supporting member in the second image forming section.

2. The image forming apparatus according to claim 1, wherein the controller controls the first image forming section and the second image forming section to allow the first velocity to be greater than the second velocity.

3. The image forming apparatus according to claim 1, wherein the first image forming section and the second image forming section each further include a developer regulating member and a first power supply section, the developer regulating member being configured to be in contact with the surface of the developer supporting member to form a layer of the developer on the surface of the developer supporting member, and the first power supply section being configured to apply a voltage to the developer regulating member, and the controller controls the first power supply sections to allow a first voltage value and a second voltage value to be different from each other, the first voltage value being an absolute value of the voltage applied to the developer regulating member in the first image forming section, and the second voltage value being an absolute value of the voltage applied to the developer regulating member in the second image forming section.

4. The image forming apparatus according to claim 3, wherein the controller controls the first power supply sections to allow the first voltage value to be smaller than the second voltage value.

5. The image forming apparatus according to claim 1, wherein the first image forming section and the second image forming section each further include a second power supply section configured to apply a voltage to the developer supporting member, and the controller controls the second power supply sections to allow an absolute value of the voltage applied to the developer supporting member in the first image forming section to be smaller than an absolute value of the voltage applied to the developer supporting member in the second image forming section.

6. The image forming apparatus according to claim 1, wherein the auxiliary layer is a monochrome layer.

7. The image forming apparatus according to claim 6, wherein the monochrome layer is a white layer.

8. The image forming apparatus according to claim 1, wherein the auxiliary layer is one of an underlayer of the image layer and an overcoat layer of the image layer.

9. The image forming apparatus according to claim 1, wherein the first image forming section uses a white developer as the developer to form the auxiliary layer, and the second image forming section uses a monochrome developer as the developer to form the image layer, the monochrome developer having a color other than white.

10. The image forming apparatus according to claim 1, wherein the first image forming section uses a white developer as the developer to form the auxiliary layer, and the controller controls the first image forming section to allow the first velocity to be in a range from 310 mm/s to 380 mm/s.

11. An image forming apparatus, comprising:

a first image forming section including an image supporting member and a developer supporting member, and configured to form an auxiliary layer, the image supporting member being configured to support a latent image on a surface thereof, and the developer supporting member being configured to support, on a surface thereof, a developer that is to be supplied to the image supporting member and allows the latent image to be developed;

a second image forming section including an image supporting member and a developer supporting member, and configured to form an image layer, the image supporting member being configured to support a latent image on a surface thereof, and the developer supporting member being configured to support, on a surface thereof, a developer that is to be supplied to the image supporting member and allows the latent image to be developed; and a controller configured to control the first image forming section and the second image forming section to allow a first velocity ratio and a second velocity ratio to be different from each other, the first velocity ratio being a ratio of a traveling velocity of the surface of the developer supporting member to a traveling velocity of the surface of the image supporting member in the first image forming section, and the second velocity ratio being a ratio of a traveling velocity of the surface of the developer supporting member to a traveling velocity of the surface of the image supporting member in the second image forming section.

12. The image forming apparatus according to claim 11, wherein the controller controls the first image forming section and the second image forming section to allow the first velocity ratio to be greater than the second velocity ratio.

13. The image forming apparatus according to claim 11, wherein the first image forming section uses a white developer as the developer to form the auxiliary layer, and the controller controls the first image forming section to allow the first velocity ratio to be in a range from 1.35 to 1.65.

14. An image forming apparatus, comprising:

a first image forming section including an image supporting member, a developer supporting member, a developer regulating member, and a power supply section, and configured to form an auxiliary layer, the image supporting member being configured to support a latent image on a surface thereof, the developer supporting member being configured to support, on a surface thereof, a developer that is to be supplied to the image supporting member and allows the latent image to be developed, the developer regulating member being configured to be in contact with the surface of the developer supporting member to form a layer of the developer on the surface of the developer supporting member, and the power supply section being configured to apply a voltage to the developer regulating member;

a second image forming section including an image supporting member, a developer supporting member, a developer regulating member, and a power supply section, and configured to form an image layer, the image supporting member being configured to support a latent image on a surface thereof, the developer supporting member being configured to support, on a surface thereof, a developer that is to be supplied to the image supporting member and allows the latent image to be developed, the developer regulating member being configured to be in contact with the surface of the developer supporting member to form a layer of the developer on the surface of the developer supporting member, and the power supply section being configured to apply a voltage to the developer regulating member; and a controller configured to control the power supply sections to allow a first voltage value and a second voltage value to be different from each other, the first voltage value being an absolute value of the voltage applied to the developer regulating member in the first image forming section, and the second voltage value being an absolute value of the voltage applied to the developer regulating member in the second image forming section.

15. The image forming apparatus according to claim 14, wherein the controller controls the power supply sections to allow the first voltage value to be smaller than the second voltage value.

* * * * *